US009819083B1

(12) United States Patent
Chen et al.

(10) Patent No.: US 9,819,083 B1
(45) Date of Patent: Nov. 14, 2017

(54) ARRAY ADAPTIVE BEAMFORMING FOR A LARGE, ARBITRARY, SPARSE ARRAY

(71) Applicant: Northrop Grumman Systems Corporation, Falls Church, VA (US)

(72) Inventors: Yenming Chen, Torrance, CA (US); John M. Trippett, Torrance, CA (US); Scott Siegrist, Hermosa Beach, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 646 days.

(21) Appl. No.: 14/468,509

(22) Filed: Aug. 26, 2014

(51) Int. Cl.
*H01Q 3/00* (2006.01)
*H01Q 3/40* (2006.01)

(52) U.S. Cl.
CPC ..... *H01Q 3/40* (2013.01)

(58) Field of Classification Search
CPC ..... H01Q 3/00; H01Q 3/40
USPC ..... 342/373
See application file for complete search history.

(56) References Cited

U.S. PATENT DOCUMENTS

| | | | | |
|---|---|---|---|---|
| 6,653,973 | B2 | 11/2003 | Yu | |
| 9,426,007 | B1 * | 8/2016 | Su | H04L 27/0012 |
| 2009/0046010 | A1 * | 2/2009 | Niu | H04B 7/0691 342/373 |
| 2011/0316739 | A1 | 12/2011 | Chang | |
| 2014/0066757 | A1 * | 3/2014 | Chayat | G01S 13/89 600/430 |

OTHER PUBLICATIONS

Ahn, H. et al; Digital Beamforming in a large conformal Phased Array Antenna for satellite operations support—Architecture, design, and development; Phased Array Systems and Technology (Array); 2010 IEEE International Symposium on, pp. 423-431; Oct. 12-15, 2010.

Jamil, K. et al; A multi-band multi-beam software-defined passive radar part I: System design; Radar Systems (Radar 2012); IET International Conference on, pp. 1-4; Oct. 22-25, 2012.

Wang, X. et al; Smart antenna design for GPS/GLONASS anti-jamming using adaptive beamforming; Microwave and Millimeter Wave Technology (ICMMT); 2010 International Conference on, pp. 1149-1152; May 8-11, 2010.

Wilden; H. et al; Low-cost radar receiver for european space surveillance; Radar Systems (Radar 2012); IET International Conference on; pp. 1-5; Oct. 22-25, 2012.

Daryoush, A.S. et al; Digitally beamformed multibeam phased array antennas for future communication satellites; Radio and Wireless Symposium; 2008 IEEE; pp. 831-834; Jan. 22-24, 2008.

(Continued)

*Primary Examiner* — Harry Liu
(74) *Attorney, Agent, or Firm* — Patti & Malvone Law Group, LLC

(57) ABSTRACT

A method and apparatus in one example uses adaptive digital beamforming with a plurality of heterogeneous antennas which are more affordable and flexible and do not require the use of a nuller antenna. The method uses adaptive, multi-beam digital beamforming without knowledge of a signal direction or aperture of the antena. The method works with arbitrary antenna elements in arbitrary locations and does not require any a priori antenna model. The method also optimizes signal-to-noise ratio (SNR) of the received signal.

26 Claims, 21 Drawing Sheets

(56) References Cited

OTHER PUBLICATIONS

Zhao, P. et al; Performance of a Concurrent Link SDMA MAC Under Practical PHY Operating Conditions; Vehicular Technology, IEEE Transactions on; vol. 60, No. 3; pp. 1301-1307; Mar. 2011.
Wolz, B. et al; Region Coordination across Space Division Multiple Access Enhanced Base Stations in IEEE 802.16m Systems; Wireless Communications and Networking Conference Workshops (WCNCW); 2010 IEEE; pp. 1-7; Apr. 18-18, 2010.

* cited by examiner

ARRAY ADAPTIVE BEAMFORMING FOR A LARGE, ARBITRARY, SPARSE ARRAY

BACKGROUND

The invention relates generally to a method and system for digital beamforming in an arbitrary antenna system, using any waveforms in space, airborne, and ground network, and any combinations thereof.

BACKGROUND

Satellite antenna systems are often used to provide communications between mobile ground-based terminals. Reliable communications between terminals is preferable to all users however, some applications have an especially critical need for robust operation. Military applications, for example, require a system that maintains communication between highly mobile terminals even in the presence of jamming signals and other sources of interference. Although jamming will be discussed below, the invention is equally applicable to any source of interference in a communication signal, intentional or unintentional.

Beamforming is a technique wherein beams from a plurality of transmitters and/or receivers are combined to provide directional signal transmission or reception. Beamformers are especially useful in the presence of a jamming signals, where a null can be used to cancel out the jamming signal while the antenna is still able to listen to signals from other directions. In a communication environment with large jamming sources in the same receive bandwidth as the preferred directional signal from a terminal, communication performance will be degraded significantly if anti-jamming measures are not employed. Numerous techniques have been proposed for dealing with this type of problem. Nulling approaches (Howells-Applebaum, U.S. Pat. No. 5,175,558, and U.S. Pat. No. 6,130,643) all attempt to preserve an overall pattern performance to all possible users, across the full system bandwidth, in the presence of jammer signals. An antenna with a nuller uses beamforming to constructively add signals from a desired source such as a mobile terminal, and cancel out the signals from a jamming or other undesired source. These approaches, however, are suboptimal.

One example of a prior art system using analog beamforming is shown in FIGS. 1A-1C. FIG. 1A depicts a system in a benign environment, where three pixel beams 202 are combined into a single composite theater beam 204. Three mobile terminals are shown in the theater at 206. Although three pixel beams are shown, any number could be used. FIG. 1B depicts a similar system of three pixel beams 202 in a contested environment having three mobile terminals 206. Composite theater beam 208 is distorted by the presence of jammer 210. While FIGS. 1A and 1B show three mobile terminals, this is just representative and any number could be present.

An apparatus for generating composite beams 204 and 208 is shown in FIG. 1C. A multiple beam antenna (MBA) 212 is shown with 7 beams, although any appropriate number of beams could be used. The output from MBA 212 is sent to analog beamformer 214 which generates composite beam 204 or 208 of FIGS. 1A and 1B respectively. Analog to digital converter (ADC) 216, channelizer 218 and demodulator 220 represent the payload architecture that processes the received signal digitally and demodulates user symbols in baseband. A negative feature of this apparatus is the requirement for a large and complex antenna. In addition, the traditional beamforming performed in the prior art requires a known scan direction and a known antenna aperture model to steer the beam in the desired direction.

In addition, communication with terminals in a theater of operations may experience several challenges. First, it is necessary to provide high gain to small power terminals. The theater may feature a heterogeneous environment with large and small power terminals close together spacially and in frequency. Finally, it may be necessary to provide high anti-jamming capabilities in a contested environment and also to enable autonomous tracking of small power terminals in the theater.

Approaches using a diverse set of antenna elements or an unknown aperture suffer from antenna model inaccuracies that severly limit performance and also experience grating lobes that contribute additional interference. Thus, there exists a need for a satellite antenna system that can perform adaptive beamforming without knowledge of signal direction or aperture. Furthermore, there is a need for a method that optimizes for each user independently only over the user receive bandwidth.

SUMMARY

A method and apparatus for performing multi-beam digital beamforming of simultaneous signals from multiple independent receive sources is disclosed. The approach is antenna agnostic and works with arbitrary antenna elements in arbitrary locations. It does not require any a priori antenna model and uses adaptive digital beamforming in a way that optimally combines the antenna elements to form a unique beam for each user, while maximizing signal-to-noise (SNR) and providing significant interference rejection. Because the approach functions without knowledge of the antenna characteristics, costly antenna characterization and calibration are not needed. This invention leverages the MBA adaptive digital beamforming described in copending application Ser. No. 14/468,560 titled Method and Apparatus for Symbol Measurement and Combining filed on the same date as the present application and extends the approach to arbitrary antenna architectures. The flexibility of this approach allows for improved performance in terms of gain, G/T and interference suppression at reduced system complexity.

The invention in one implementation encompasses a method for adaptive digital beamforming, in a computer processor, the input signals received by a plurality of heterogeneous antennas, having the steps of estimating an initial weight for each beam only from information contained within a received input signal from each beam without using a model of the plurality of heterogeneous antennas or knowing the desired signal direction; iteratively estimating a new weight for each beam until an optimum weight is achieved; and applying the optimum weight for each beam to the received input signals.

In further embodiment, the invention encompasses a method for digital beamforming the beams from a plurality of heterogeneous antennas including the steps of receiving an input signal from each beam of the plurality of antennas; processing each input signal statistically to generate symbols representing each input signal; estimating an initial steering vector for each beam from the input signal and the generated symbols; estimating an initial covariance matrix using direct calculation with dynamic noise loading; generating a set of weights for the beams from the one or more antennas from the initial steering vector and the initial covariance matrix; iteratively estimating a new weight for each beam until an optimum weight is achieved; and normalizing the optimum weight and applying it to the received symbols during digital beamforming.

In yet another embodiment, the invention encompasses a non-transitory computer-readable medium storing computer-readable instructions that, when executed on a computer processor, perform a method of digital beamforming the beams from a plurality of heterogeneous antennas including the steps of receiving an input signal from each beam of the plurality of antennas; processing each input signal statistically to generate symbols representing each input signal; estimating an initial steering vector for each beam from the input signal and the generated symbols; estimating an initial covariance matrix using direct calculation with dynamic noise loading; generating a set of weights for the beams from the one or more antennas from the initial steering vector and the initial covariance matrix; iteratively estimating a new weight for each beam until an optimum weight is achieved; and normalizing the optimum weight and applying it to the received symbols during digital beamforming.

DESCRIPTION OF THE DRAWINGS

Features of example implementations of the invention will become apparent from the description, the claims, and the accompanying drawings in which:

DETAILED DESCRIPTION

In general, beamforming combines signals from a single multi-beam antenna or an array of single-beam antennas to transmit and receive directional signals using the principles of constructive and destructive interference. Signals detected by each beam are phased, or weighted, by varying amounts so as to transmit or receive a desired signal from a terminal.

Figure 1A:
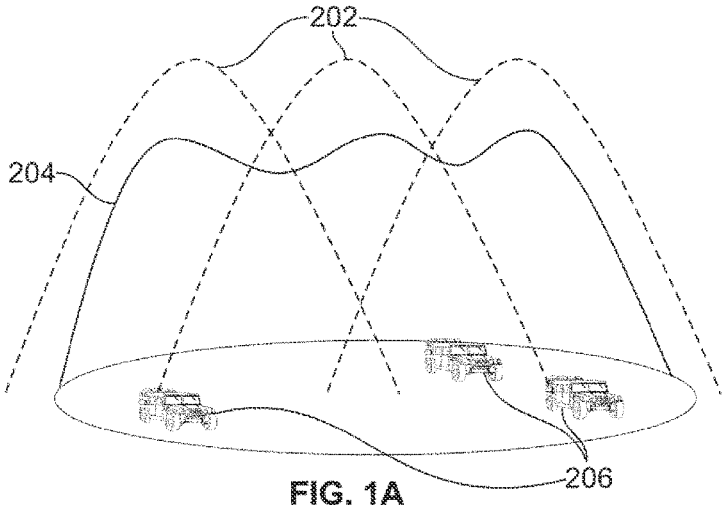
FIG. 1A (Prior Art)
FIGS. 1A-1C depict a prior art system using analog beamforming.
Figure 1B:
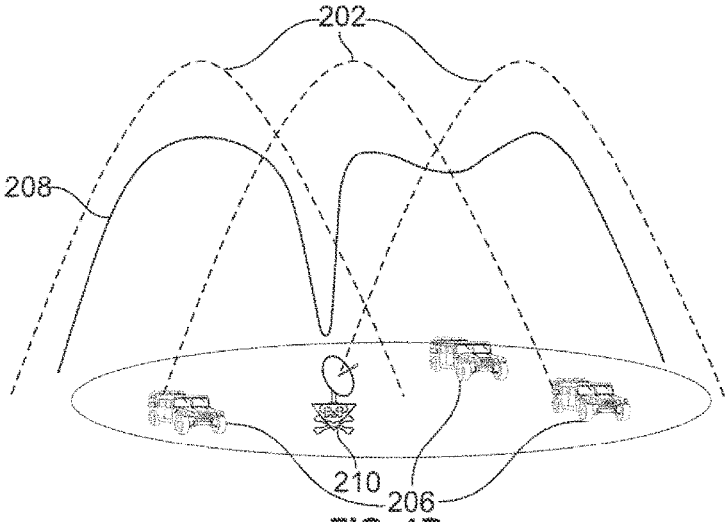
FIG. 1B (Prior Art)
Figure 1C:
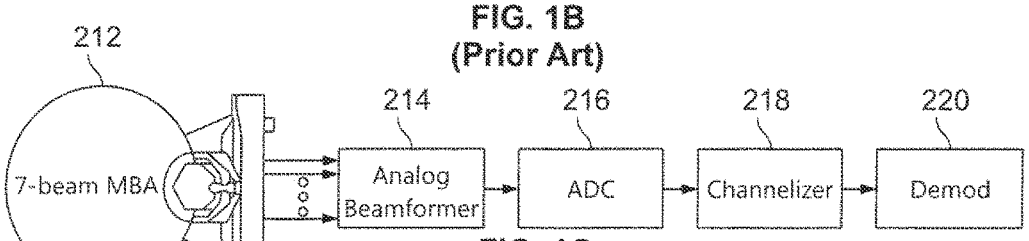
FIG. 1C (Prior Art)
Figure 2A:
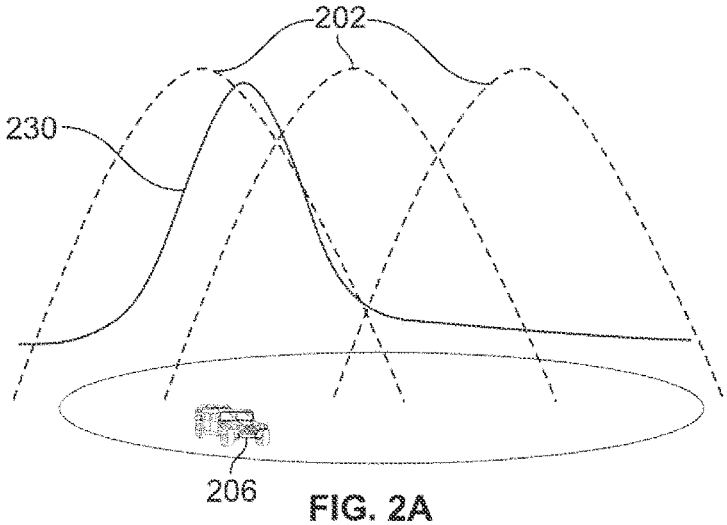
FIGS. 2A-2C depict a system for digital beamforming.
Figure 2B:
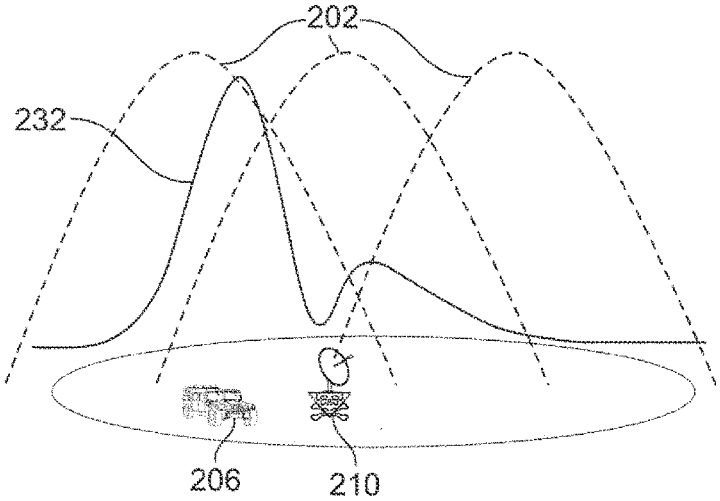
Figure 2C:
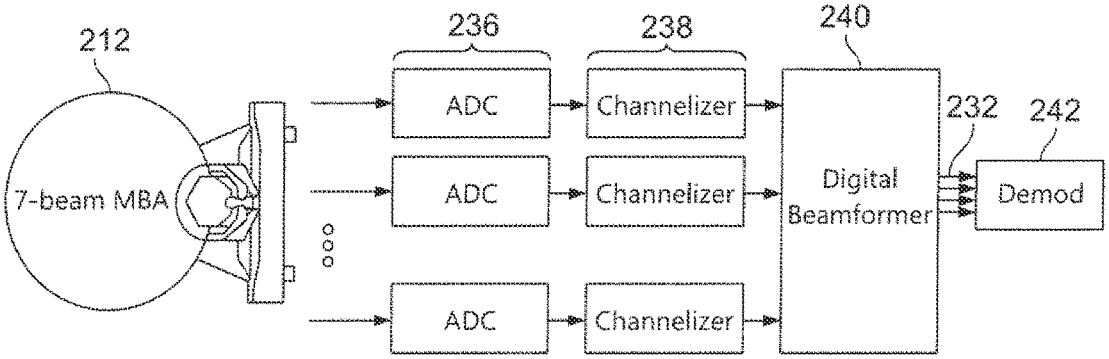

An improvement on the prior art device of FIGS. 1A-1C is shown in FIGS. 2A-2C. Instead of analog beamformer 214 of FIG. 1C, FIG. 2C depicts the same 7 beam MBA 212 but each output beam is converted from analog to digital using ADCs 236, separated into channels with channelizers 238, then combined using adaptive digital beamformer 240. The adaptive digital beamformer is further described in copending application Ser. No. 14/468,560 titled Method and Apparatus for Symbol Measurement and Combining which is hereby incorporated by reference. The use of the adaptive digital beamformer 240 allows beamforming to be targeted to individual terminals as shown by dynamic beam 230 of FIG. 2A, which has been optimized to a specific user in an unstressed environment. As shown in FIG. 2C, adaptive digital beamformer 240 is able to output a custom beam for each terminal in the system. FIG. 2B shows an optimized dynamic beam 232 in the presence of jammer 210, which is then demodulated by demodulator 242.

While an improvement on the prior art, the system of FIGS. 2A-2C still features the use of a large, expensive MBA that includes a nuller. The challenges of communication with small mobile terminals in a heterogeneous environment can be further improved by using adaptive beamforming with alternative antenna systems featuring a plurality of low cost spot beam antennas.

In an embodiment, the invention adapts the co-pending adaptive digital beamforming method to work with a plurality of GDAs (gimball drive/dish antenna) which are more affordable and flexible and do not require the use of a large MBA antenna. With this embodiment, adaptive, multi-beam digital beamforming can be performed without knowledge of a signal direction or aperture of the antenna. The method works with arbitrary antenna elements in arbitrary locations and does not require any a priori antenna model. Among other features, the method maximizes SNR, eliminates the need for costly calibration of the antenna aperture, suppresses sources of intentional and unintentional interference and adapts to a changing environment, for example, user mobility, interference, and aperture distortions.

Without a need to rely on a specific antenna model, large distributed elements can be combined for greatly increased antenna gain and interference suppression. The adaptive nature of the inventive method provides very high levels of performance without the consequences of antenna model inaccuracies and interference from grating lobes. Improved antenna performance provides more throughput and more efficient channel utilization. It also reduces the complexity of transmitters/receivers and therefore results in a cost savings.

Figure 3:
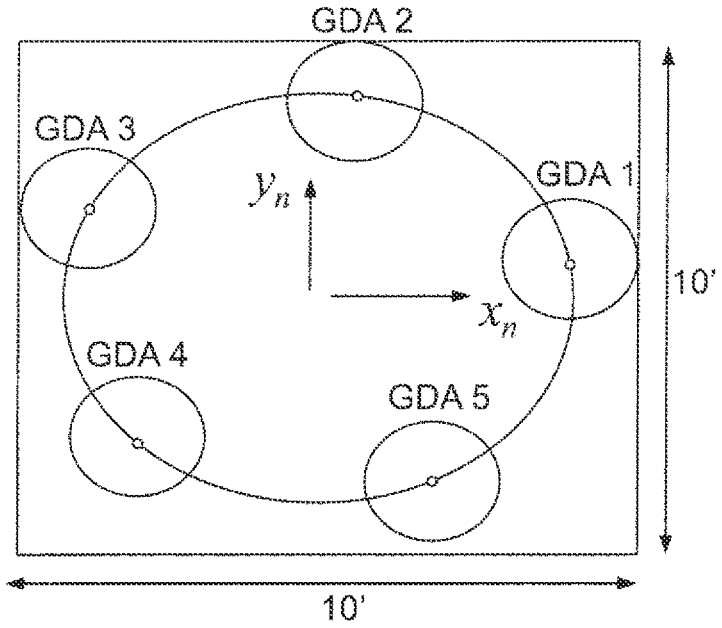
FIG. 3 depicts an embodiment of a Gimbal Dish Antenna (GDA) system.

FIG. 3 depicts an embodiment of a GDA adaptive digital beamforming system. While specific measurements are shown, they are representative and could be varied as needed to meet cost and performance considerations. In general, the number and configuration of GDAs can be optimized to provide a large effective aperture which produces high gain and extremely sharp nulls at a much lower cost than a single multi-beam antenna. As shown in FIG. 3, five GDAs, each having a radius of approximately 1', are mounted on a platform measuring 10'×10' in a circle with a radius of approximately 4'.

Figure 4:
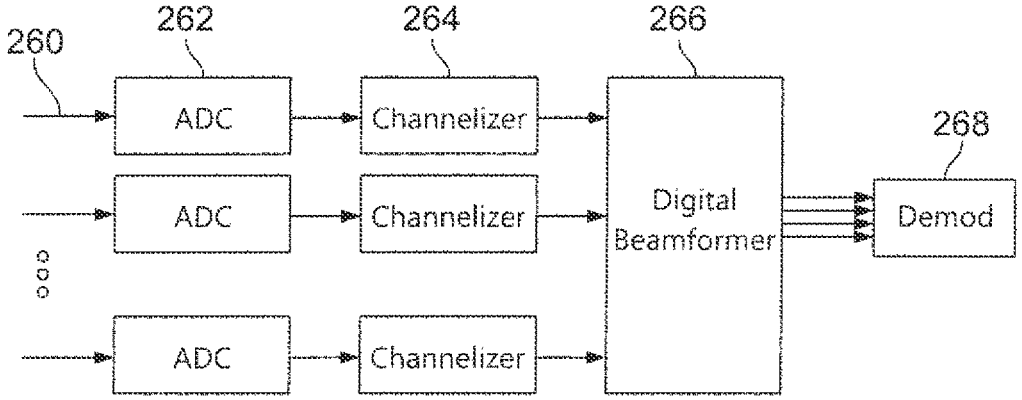
FIG. 4 depicts a system for digital beamforming the embodiment of FIG. 3.

A system for implementing the embodiment of FIG. 3 is shown in FIG. 4. Individual beams 260 from, for example, 5 spot beams, are received from a sparse array of GDAs at a plurality of ADCs 262. After being converted to digital signals, each beam is sent through a channelizer 264 then to adaptive digital beamformer 266, which generates an optimized beam for each user of the system that is sent to demodulator 268. The system of FIG. 4 can be implemented, for example, with a FPGA (field-programmable gate array) to enable reprogrammability of processing as needed. An ASIC (application-specific integrated circuit) could also be used to implement the invention.

The use of independent antennas provides a number of benefits. The individual antennas are more affordable, both in the physical design and their integration on a platform. Data rates are scalable based on the number of antenna elements used and their individual gain. Since the phased array has a larger effective aperture size, additional anti-jamming capability is enabled.

Figure 5A:
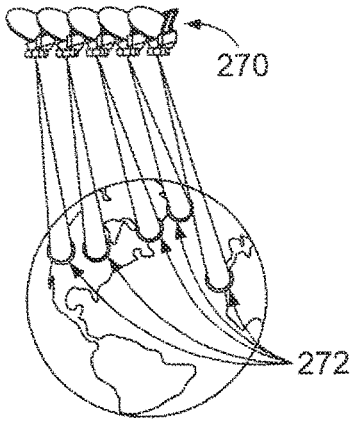
FIG. 5A depicts a GDA system serving dispersed users.
Figure 5B:
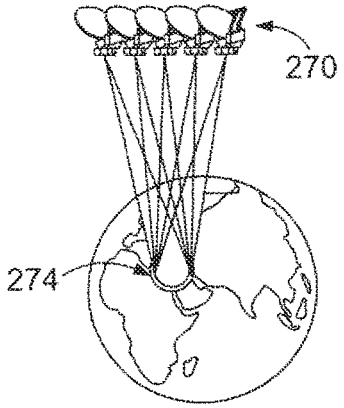
FIG. 5B depicts a GDA system used in a concentrated theater.
Figure 6A:
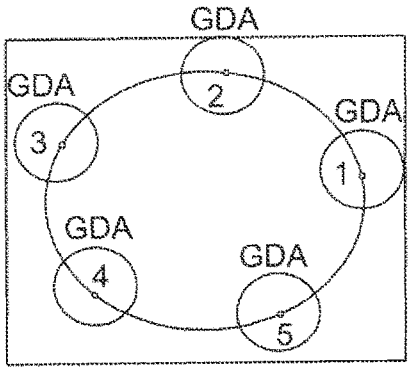
FIGS. 6A-6D show several representative configurations of GDAs on a platform.
Figure 6B:
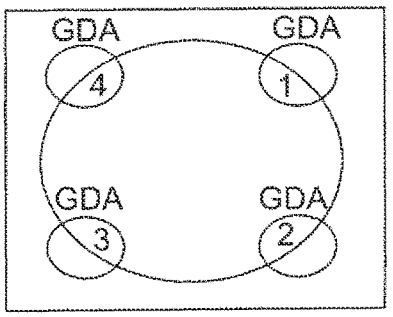
Figure 6C:
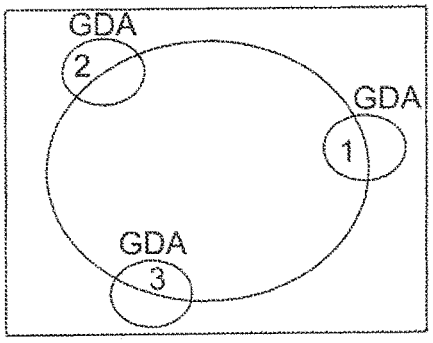
Figure 6D:
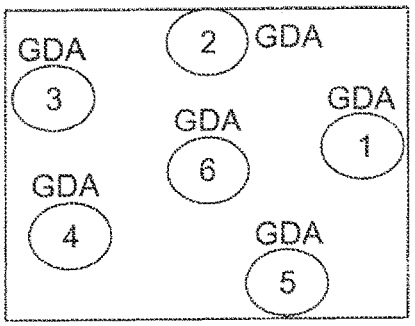

This invention works in space, airborne, and ground architectures, and with any antenna systems. For space to terminal communication where digital beamforming is processed on satellite, FIGS. 5A and 5B depict two possible embodiments of the invention. In FIG. 5A, a plurality of antennas 270 behave as standard GDAs serving dispersed users 272. In FIG. 5B, the plurality of antennas 270 are beamformed in a concentrated theater 274 to provide higher theater gain and in beam AJ protection. The embodiments shown in FIGS. 5A and 5B depict a space-based environment but airborne or ground-based architecture could also be used. The number and placement of GDAs is flexible. FIGS. 6A-6D show several configurations, using from 3 to 6 GDAs. The arrangements shown in FIGS. 6A-6D are intended as examples of possible configurations.

Figure 7:
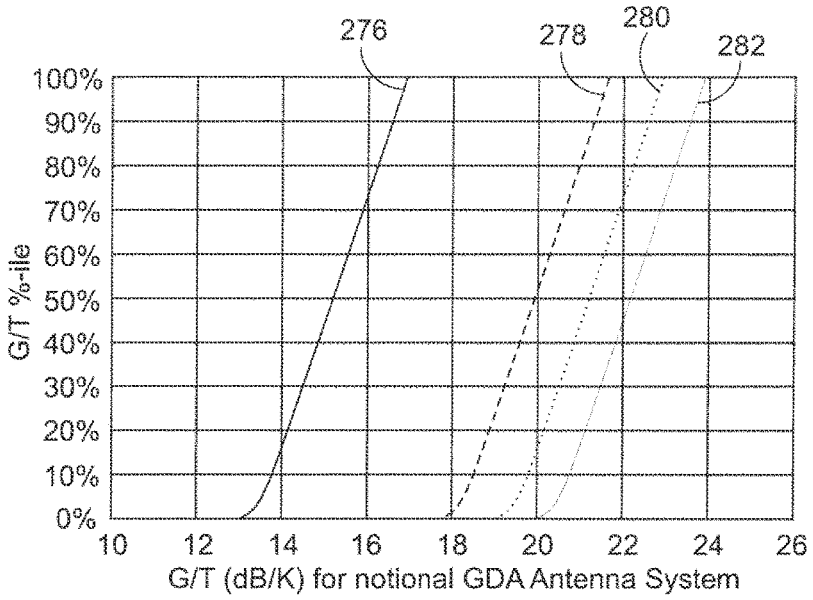
FIG. 7 shows a graph depicting G/T performance in a scalable GDA system.

For the embodiment of the invention shown in FIG. 5B, all elements of the antenna array are pointed to the same coverage area 274 creating co-pointed GDA beams. A digital beamforming system shown in FIG. 4 where ideal beam combining performance that scales with the number of elements in the antenna system is achieved. FIG. 7 shows a graph depicting G/T performance in a scalable GDA system as antenna elements are added optimally to increase G/T with each added element scalable G/T is achieved based on number of elements dedicated to theater antenna. The performance of 1 GDA is shown at 276. Line 278 shows performance with 3 GDA beamforming, line 280 with 4 GDAs and line 282 with 5 GDAs.

Figure 8A:
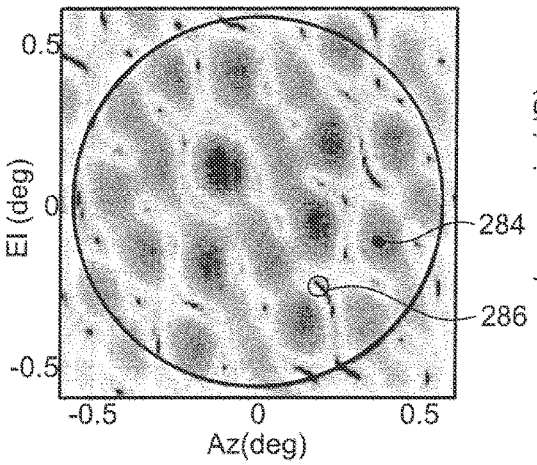
FIGS. 8A and 8B depict antenna gain coverage and a gain plots for a user in the presence of a jammer.
Figure 8B:
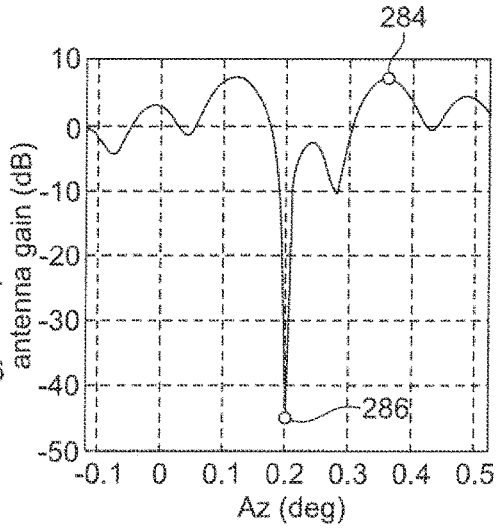

Moreover, this invention creates an antenna gain response maximizing the intended user gain while nulling out the jammer in the close proximity as shown in FIGS. 8A and 8B, which depict an antenna gain plot is shown through user 284 and jammer 286 with high gain on user 284 and deep null on jammer 286.

Figure 9A:
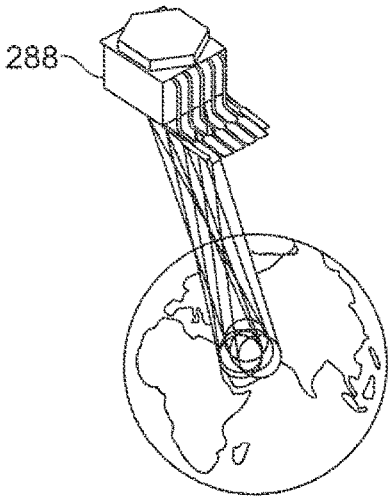
FIG. 9A depicts a phased array antenna in accordance with an embodiment of the invention.
Figure 9B:
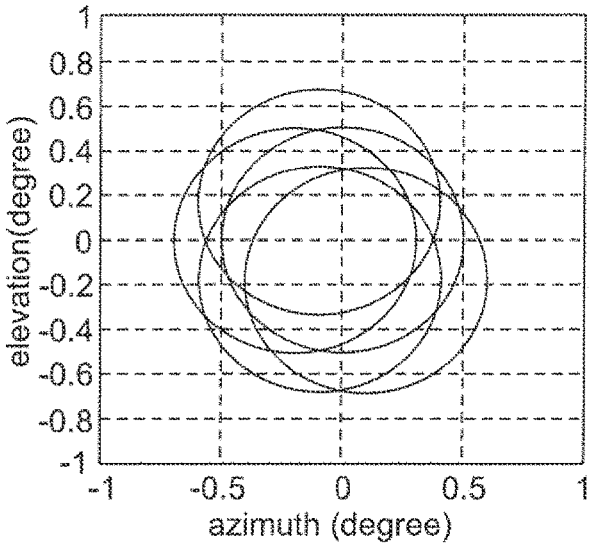
FIG. 9B depicts a beam laydown plot in accordance with the embodiment of FIG. 9A.
Figure 9C:
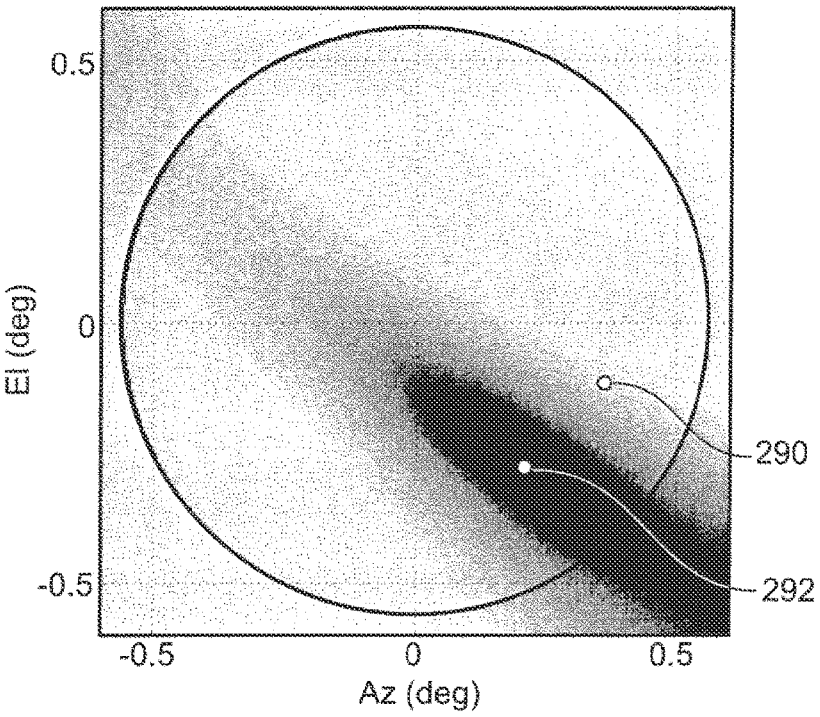
FIG. 9C depicts the antenna gain response of the phased array digital beamforming in accordance with the embodiment of FIG. 9A.

Another embodiment of the invention uses phased array antenna 288 as shown in FIG. 9A, with an example of beam laydown shown in FIG. 9B using 5 phased array beams where the x-axis label is the azimuth in degrees and the y-axis is elevation in degrees. FIG. 9C shows the antenna gain response of the phased array digital beamforming, clearly nulling out jammer 292 in the close proximity of user 290 as an example. The embodiments shown in FIGS. 9A-9C depict a space-based environment but airborne or ground-based architecture could also be used.

Figure 10A:
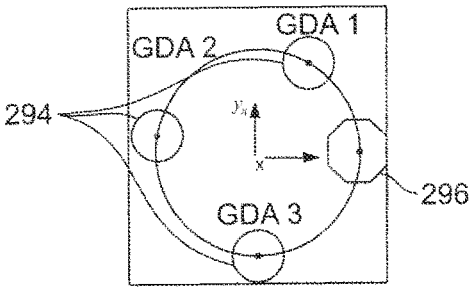
FIG. 10A depicts an embodiment of the invention using a combination of different types of antennas.
Figure 10B:
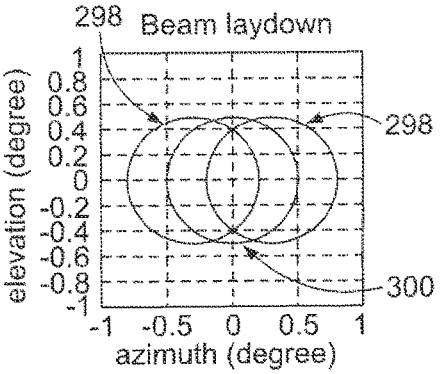
FIG. 10B depicts a beam laydown plot in accordance with the embodiment of FIG. 10A.
Figure 10C:
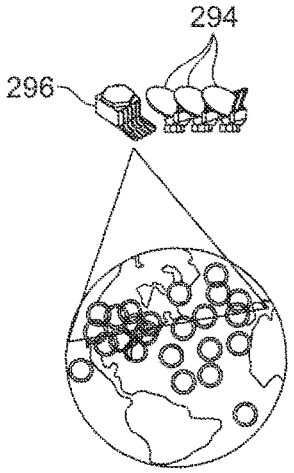
FIG. 10C depicts an embodiment where the antennas serve dispersed user.
Figure 10D:
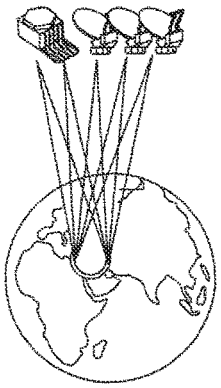
FIG. 10D depicts a related embodiment where several different types of antennas are beamformed in a concentrated theater to provide higher theater gain and in beam AJ protection.
Figure 10E:
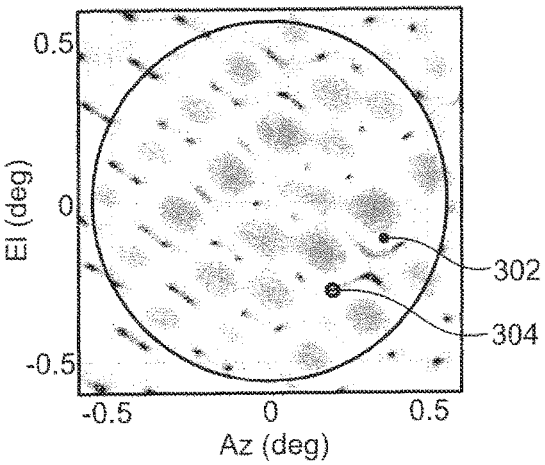
FIGS. 10E and 10F depict an antenna gain coverage and a gain plots for the embodiments of FIGS. 10A-10B.
Figure 10F:
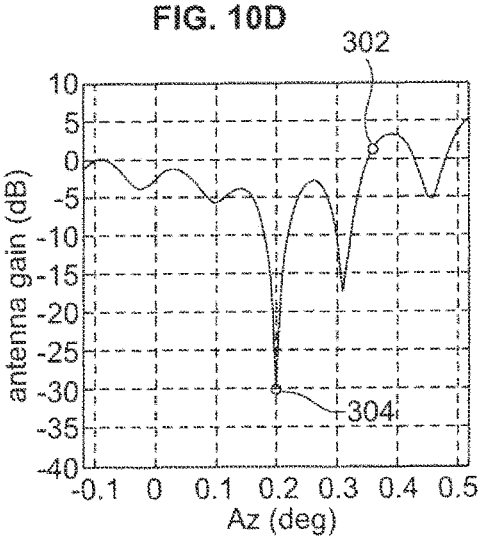

Another embodiment of the invention uses a combination of different types of antennas, GDAs and a phased array (PA) antenna, shown in FIG. 10A as an example of utilizing 3 GDAs 294 and 1 PA antenna 296 with 2 PA beams, with an example beam laydown shown in FIG. 10B where circles 298 indicate the 2 PA beams and circle 300 indicates the GDA beams. FIGS. 10C and 10D depict two possible embodiments of the invention. In FIG. 10C, the antennas behave as standard GDAs and phased array antenna serving dispersed users. In FIG. 10D, several different types of antennas are beamformed in a concentrated theater to provide higher theater gain and in beam AJ protection. The adaptive digital beamforming works in this hybrid antenna example such that the gain on jammer 304 is minimized while user 302 gain is maintained as shown in FIG. 10E and FIG. 10F.

Figure 11:
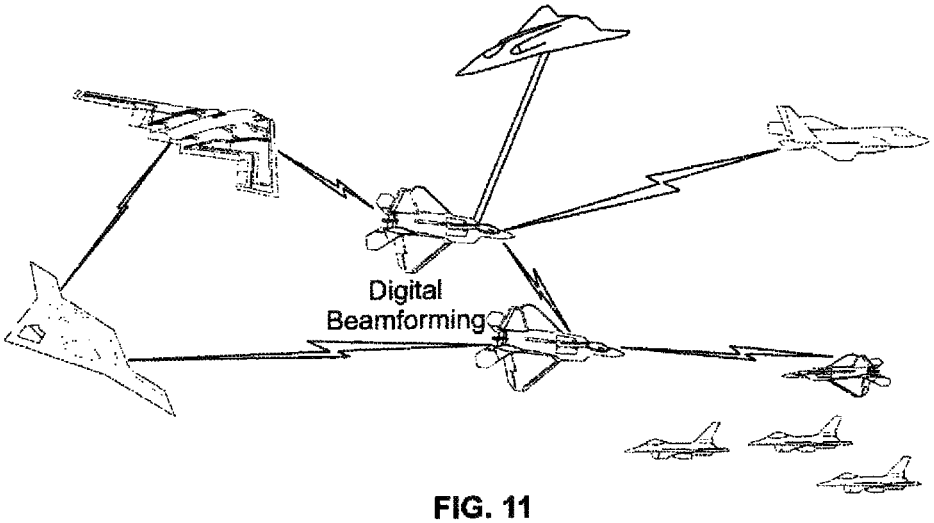
FIG. 11 depicts an embodiment of the invention used with a dynamic airborne mesh network.
Figure 12:
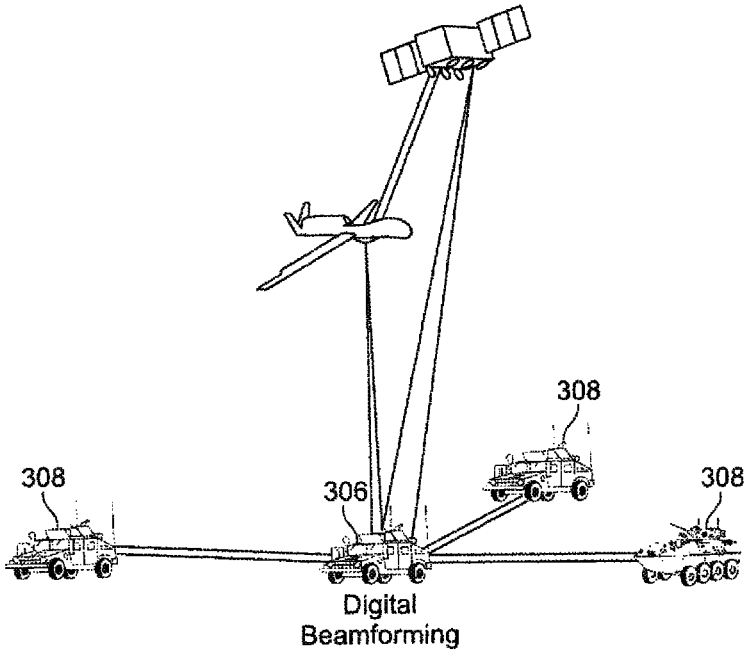
FIG. 12 depicts an embodiment of the invention used with a ground network.

Digital beamforming not only works for a space processed network and for any type of antenna, it is applicable to provide a digital beamforming solution for a dynamic airborne mesh network as illustrated in FIG. 11. Furthermore, the application of this invention extends to a ground network, shown in FIG. 12, where multiple sensors on ground terminal 306 receive information from the neighboring nodes 308 forming an ad-hoc network, processing the information using digital beamforming of this invention. FIG. 12 further depicts the capability of this invention utilizing any combinations of space, airborne, and ground network.

Figure 13A:
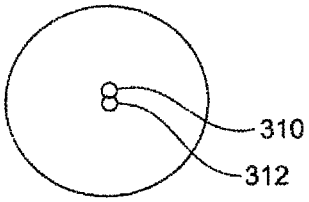
FIG. 13A depicets a scenario where a jammer is very close to a user.
Figure 13B:
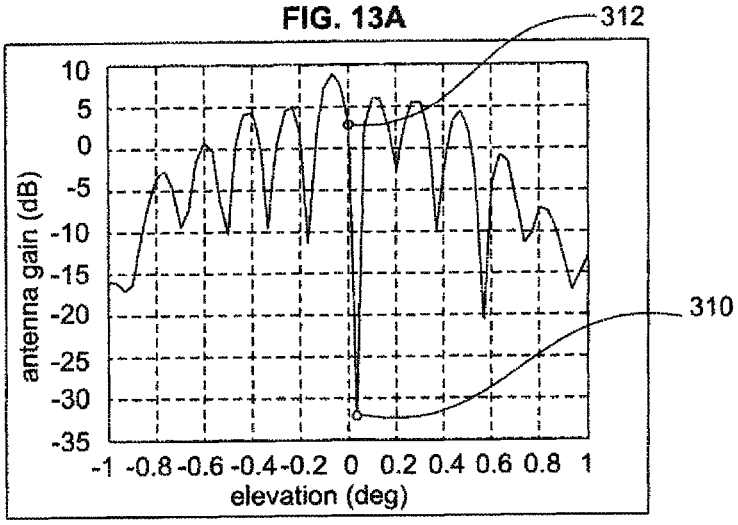
FIGS. 13B and 13C depict performance for the scenario of FIG. 13A using different antenna systems.
Figure 13C:
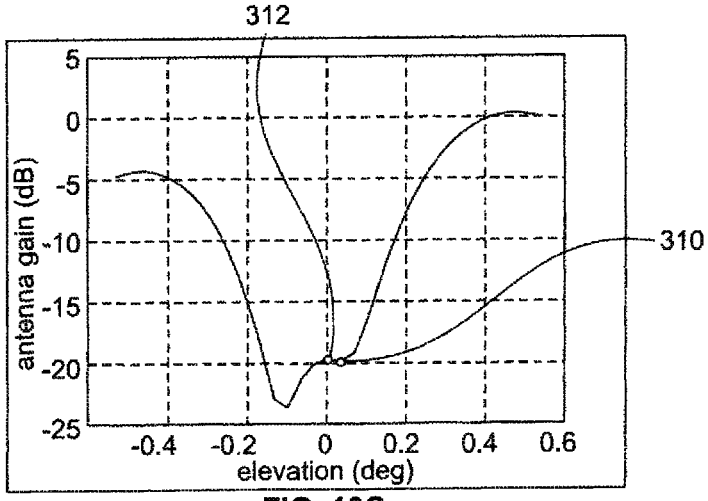

FIGS. 13B and 13C show the contrast in performance between using either a large, sparse GDA antenna array or an MBA for a particular scenario as shown in FIG. 13A, which depicts a situation where user 312 is at the center of a one degree coverage area and jammer 310 is very close to user 312, for example, approximately 15 miles away. For this most difficult case, the user 312 gain is maximized while the jammer 310 gain is significantly reduced for the GDA antenna array beamforming as shown in FIG. 13B. For the MBA digital beamforming, the user and jammer are too close; therefore, both user 312 gain and jammer 310 gain are minimized as shown in FIG. 13C. Thus this invention maximizes the SNR while producing a sharp null on jammer 310 when located in close proximity to user 312.

Figure 14A:
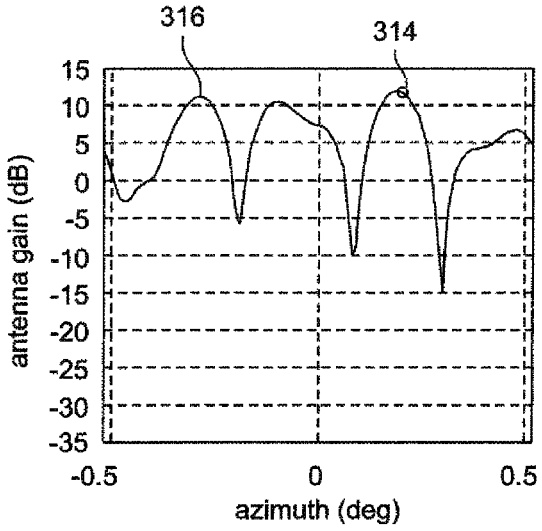
FIGS. 14A and 14B depict an embodiment of the invention where a jammer is located at a grating lobe of an antenna.
Figure 14B:
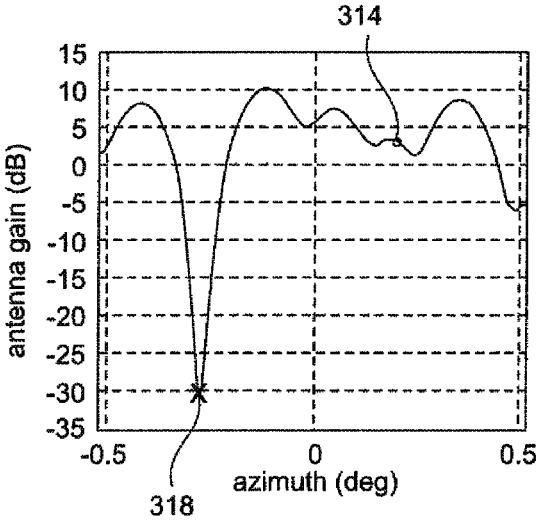

A common feature of sparse phased arrays is the presence of grating lobes. These are areas of the beam that exhibit high gain where gain is not intended or desired. It is caused by element separations of greater than half a wavelength, also known as spatial aliasing. This present invention mitigates the grating lobe concerns that jammers might be located at the peak of grating lobes. In an embodiment of the invention using a 5 GDA antenna array, the worst case grating lobe 316 is located given a user location 314 as shown in FIG. 14A. When a jammer is located at this worst case grating lobe, this invention inherently prevents gating lobes from appearing at jammer location 318 as shown in FIG. 14B, since the optimization accounts for both the signal of interest (SOI) and the interference signals. Furthermore, since the user SNR is maximized every hop, the grating lobes concerns are effectively mitigated.

Waveforms

In an embodiment, the co-pending application of the adaptive beamforming algorithm operates on symbols of a Symmetric Differential Phased Shift Keying (SDPSK) waveform received as part of signals, or beams, received from a plurality of antennas. The following description discusses the adaptive beamforming algorithm of the co-pending application.

A symbol is typically described as a pulse representing an integer number of bits. In an embodiment illustrating this method with the above mentioned antenna architectures, i.e., GDA array, phased array antenna, combinations of GDAs and phased array beams, with a total number of $N_{beam}$ beams, the input signal is represented by X given by Equation (1) as the channel model with the received symbols of length N for all beams per hop (a hop consists of N symbols) under the stressed environment, $$X = \begin{bmatrix} \underline{x}_1 \\ \vdots \\ \underline{x}_{N_{beam}} \end{bmatrix} = \begin{bmatrix} x_{1,1} & \cdots & x_{N,1} \\ \vdots & \ddots & \vdots \\ x_{1,N_{beam}} & \cdots & x_{N,N_{beam}} \end{bmatrix} = \begin{bmatrix} a_1\underline{s} + \beta_1\underline{J} + \underline{n}_1 \\ \vdots \\ \alpha_{N_{beam}}\underline{s} + \beta_{N_{beam}}\underline{J} + \underline{n}_{N_{beam}} \end{bmatrix}, \quad (1)$$

$$\text{where } \underline{\alpha} = \begin{bmatrix} \alpha_1 \\ \vdots \\ \alpha_{N_{beam}} \end{bmatrix},$$

$$\text{and } \underline{\beta} = \begin{bmatrix} \beta_1 \\ \vdots \\ \beta_{N_{beam}} \end{bmatrix} \text{ are the signal beam steering vector and}$$

jammer steering vector respectively, $\underline{s}$ is the transmitted modulated sequence of length N, $\underline{J}$ is the jammer vector of length N, and $\underline{n}_i$ is the AWGN vector of length N for beam i. The beam steering vector, $\underline{\alpha}$, indicates relative differences between the plurality of antennas receiving a signal. Likewise, each antenna experiences the jamming signal from a slightly different angle, resulting in the jammer steering vector, $\underline{\beta}$. The covariance matrix $R_{xx}$ is given by $$R_{xx} = E[XX^H] = \underbrace{\underline{\alpha}\underline{\alpha}^H}_{R_{ss}} + \underbrace{\sigma_j^2\underline{\beta}\underline{\beta}^H + \sigma_n^2 I}_{R_{nn}},$$

where $R_{ss}$ is the signal covariance matrix containing the signal of interest, $R_{nn}$ is the noise covariance matrix containing both the jammer signal and AWGN.

Digital beamforming involves applying a weight to the signal received from each antenna to arrive at a coherent result when the beams are combined. While there are several prior art methods of determining weights when beamforming in an unstressed communication environment, the Maximum Ratio Combining (MRC) receiver achieves the best results, with a weight vector given by $$\underline{w}_{MRC} = \sqrt{\text{SNR}}e^{-j\underline{\theta}_\alpha}. \quad (2)$$

where $\underline{\theta}_\alpha$ is the angle of arrival of the steering vector. Likewise, when operating in a stressed environment, Optimal Combining (OC) is an optimal receiver whose weight vector for the digital beamformer is $$\underline{w}_{OC} = R_{XX}^{-1}\underline{\alpha} \quad (3)$$

$$\text{or } \underline{w}_{OC} = R_{nn}^{-1}\underline{\alpha}, \quad (4)$$

where $R_{XX}$ is the covariance matrix of the received symbols, $\underline{\alpha}$ is the steering vector of the desired received signal without noise or jamming interference, $R_{nn}$ is the noise covariance matrix without the presence of signal. Therefore, $R_{XX}^{-1}\underline{\alpha} = cR_{nn}^{-1}\underline{\alpha}$ where c is a constant and multiplying the weights by a constant will not affect the decision space. Use of these equations requires that both the antenna configuration and the location of a desired signal are known in advance or are estimated. The weights are then applied to the received symbols in Equation (1) producing beamformed output, $\underline{y}$ $$\underline{y} = \underline{w}_{OC}^H X. \quad (5)$$

In a preferred embodiment, the inventive method improves on these methods because it works in a system in which neither the antenna configuration nor the terminal location and jammer location are known in advance. In general, locations and other parameters are not known, and must be estimated. Direct calculations of $R_{xx}$ and standard estimation techniques of $\underline{\alpha}$ result in extremely poor performance in the presence of strong power jammer; this observation is in the prior art literature without any methods provided for overcoming this problem. Instead, in a preferred embodiment, this approach works by using estimates for $R_{xx}$ and $\underline{\alpha}$ that are refined jointly by an iterative substitution method. The initial estimate for $R_{xx}$ is a direct calculation with dynamic noise loading based on the statistical characteristics of the received symbols to control the range of the norm of $R_{xx}^{-1}$. The initial estimate for $\underline{\alpha}$ is a combined maximum likelihood estimation and symbol quality evaluation across the received symbols. This method uses information only from the received symbols on a per hop basis on each of the different antenna feeds. The formed beam is optimized at each frequency based on the received symbols for each user. This method does not use any a priori spatial signal information or any history of received symbols.

In general, this method is a Substitution OC method with Dynamic Noise Loading (DNL). It consists of two major building blocks, Maximum Likelihood (ML) Alpha Estimator with Symbol Quality Estimator (SQE) and Substitution OC Method with Dynamic Noise Loading (DNL), shown in FIG. 15. The details of these building blocks are detailed in the following sections.

Figure 15:
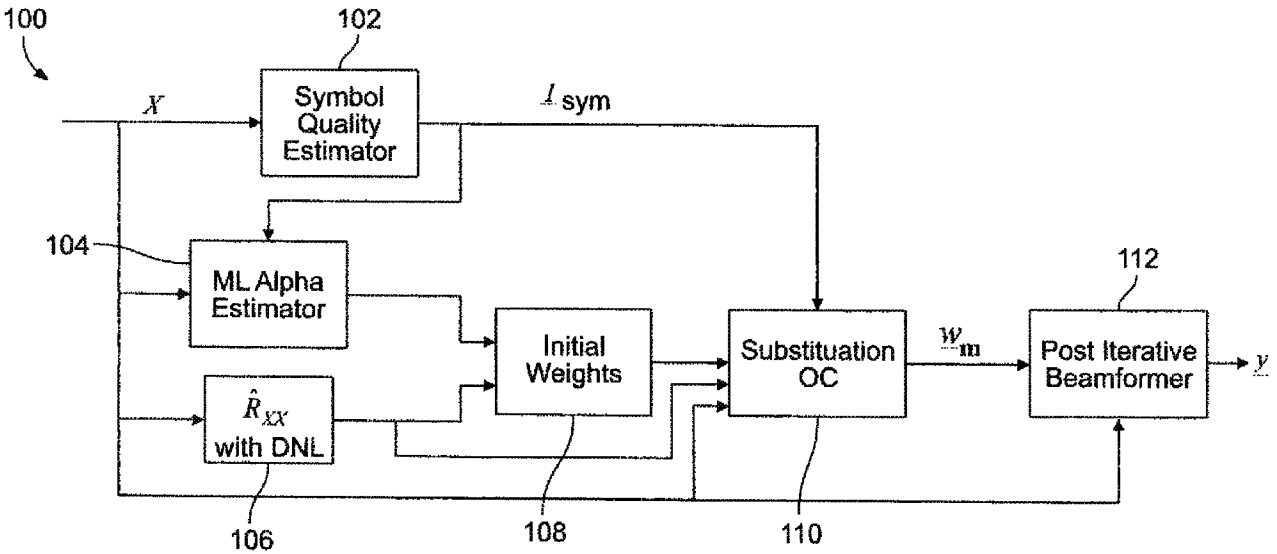
FIG. 15 is a representation of an apparatus for performing a method of digital beamforming.

Turning to FIG. 15, this method as described in the co-pending application is performed by an apparatus 100 having a number of components. Incoming symbols X are received by Symbol Quality Estimator (SQE) 102, ML Alpha Estimator 104 and $R_{xx}$ with Dynamic Noise Loading (DNL) generator 106. The estimated values for $\underline{\alpha}$ and $R_{xx}$ are sent to initial weights generator 108. SQE 102 filters noise and power spikes from the received symbols X to generate a good symbol indicator stream, $\underline{I}_{sym}$. The output of initial weights generator 108 and $\underline{I}_{sym}$ are sent to Substitution OC generator 110 which iteratively produces a weight vector, $\underline{w}_m$. This output is used by Post Iterative Beamformer 112 to generate an output beam for each mobile terminal as will be explained below. The components of FIG. 15 in a preferred embodiment would comprise FPGA (field programmable gate array) or ASIC (application-specific integrated circuit) but any type of circuitry could be used.

Maximum Likelihood (ML) Alpha Estimator

Figure 16:
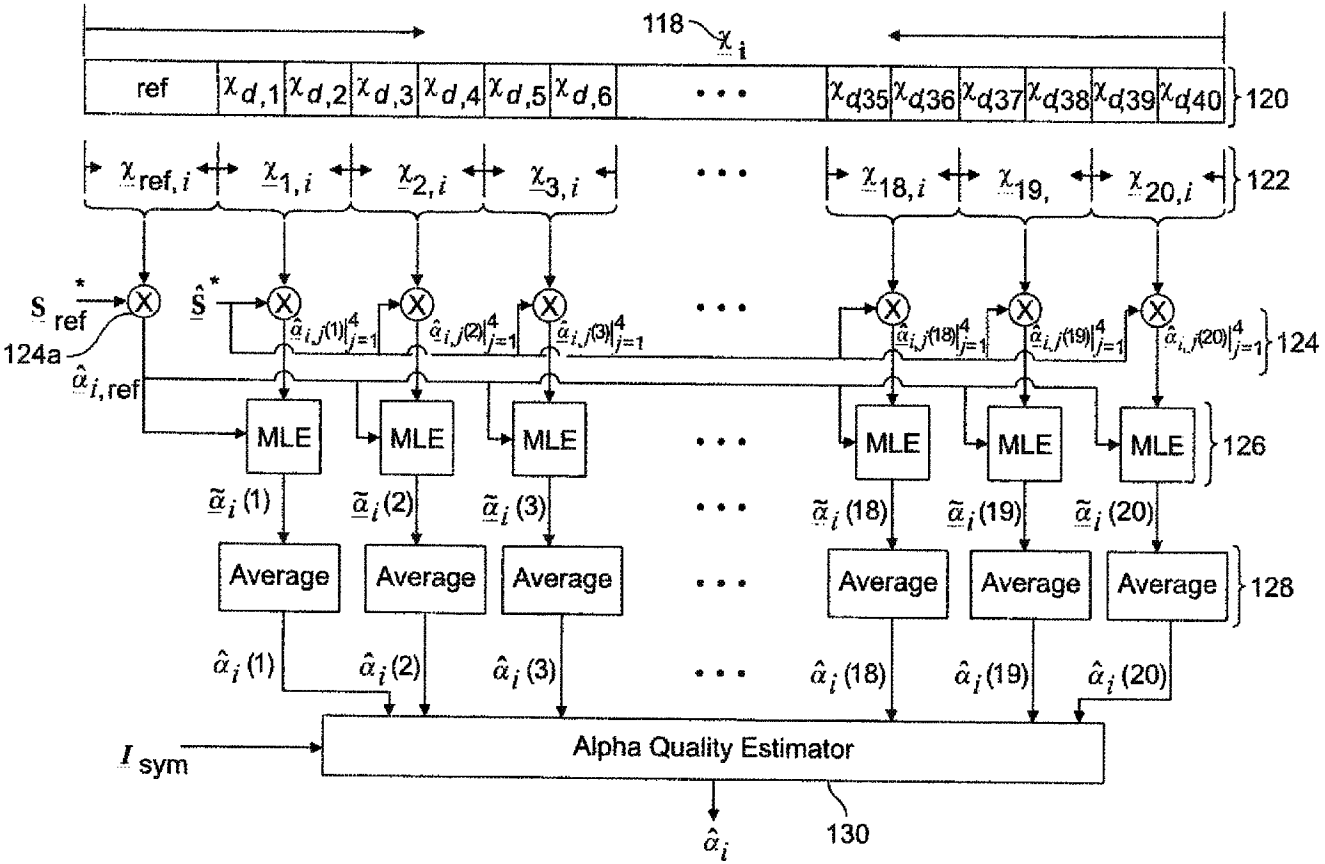
FIG. 16 is a representation of the ML Alpha Estimator of FIG. 15.

The beam steering vector, $\underline{\alpha}$, for a desired signal is calculated by ML Alpha Estimator 104 of FIG. 15. An example of the ML alpha estimator showing SDPSK 2+40 mode (a mode with 2 reference symbols and 40 data symbols) is shown in FIG. 16. Reference numeral 118 indicates complex received symbols $\underline{x}_i$ of a hop for beam i, $$\underline{x}_i=[x_{1,i}, \ldots, x_{N,i}],$$

where $N=N_{ref}+N_{data}$, $N_{ref}$ is the number of reference symbols and $N_{data}$ is the number of data symbols. The sequence of received symbols $\underline{x}_i$ 118 is a vector of X for beam i in equation (1) and FIG. 15.

In order to reduce the complexity of calculating an estimate value for $\underline{\alpha}$, the data portion of the received symbols is partitioned into blocks 120 of length $N_p$ symbols, as illustrated in FIG. 16, where $N_p=2$ is the length of the partitioned sequence in equation (6), $$x_i = \begin{bmatrix} x_{ref,i}, & \underbrace{x_{data,i}}_{\{x_{k,i}|_{k=1}^{N_{data}/2}\}} \end{bmatrix} = \left[x_{ref,i}, x_{1,i}, \ldots, x_{N_{data}/2,i}\right], \tag{6}$$

where $\underline{x}_{k,i}$, $k\in\{1, \ldots, N_{data}/2\}$ is a length-$N_p$ or length-2 sequence for partitioned sequence k and beam i. For SDPSK modulation, the four possible symbol constellations are $$\{1, e^{j\frac{\pi}{2}}, -1, e^{-j\frac{\pi}{2}}\}.$$

Assuming the starting symbol constellation of the SDPSK modulation is at 1, there are $2^{Np}$ or 4 pairs of the possible transmitted sequence, $$\hat{\underline{s}} = \{[1 \quad e^{j\frac{\pi}{2}}], [1 \quad e^{-j\frac{\pi}{2}}], [-1 \quad e^{j\frac{\pi}{2}}], [-1 \quad e^{-j\frac{\pi}{2}}]\},$$

for each partitioned sequence. At 124, the partitioned sequence is correlated with each pair of the estimated symbols, $\hat{\underline{s}}$, which provides a set of alpha estimates of the partitioned sequence.

Correlators 124 output the alpha estimates of each partitioned sequence as shown in equation (7):

$$\hat{\underline{\alpha}}_{i,j}(k) = \underline{x}_{k,i}\begin{bmatrix} \hat{\underline{s}}_j(1)* & \ldots & 0 \\ \vdots & \ddots & \vdots \\ 0 & \ldots & \hat{\underline{s}}_j(N_p)* \end{bmatrix}, \tag{7}$$

where $k=1, \ldots, N_{data}/2$, $j=1, \ldots, 2^{Np}$, i is the beam number, $N_p=2$, and $\hat{\underline{s}}=\{\hat{\underline{s}}_j|_{j=1}^{4}\}$. Given the known transmitted reference symbols $\underline{S}_{ref}=[s_{ref}(1), \ldots, s_{ref}(N_{ref})]$ of length $N_{ref}$, the alpha estimate for the received reference sequence is output from correlator 124*a* as $$\hat{\underline{\alpha}}_{i,ref} = x_{ref,i}\begin{bmatrix} s_{ref}(1)* & \ldots & 0 \\ \vdots & \ddots & \vdots \\ 0 & \ldots & s_{ref}(N_{ref})* \end{bmatrix}. \tag{8}$$

A decision metric is calculated by MLEs 126 using equation (9):

$$d_{i,j}(k)=\text{sum}[\hat{\underline{\alpha}}_{j,ref}\hat{\underline{\alpha}}_{i,j}(k)]=\hat{\underline{\alpha}}_{i,ref}I_{N_{ref}}^{t}+\hat{\underline{\alpha}}_{i,j}(k)I_p^{t}, \quad \text{for } j=1, \ldots, 2^{Np}, \tag{9}$$

where $$I_{N_{ref}} = [\underbrace{1 \quad \ldots \quad 1}_{N_{ref}\,times}], \; I_{N_p} = [\underbrace{1 \quad \ldots \quad 1}_{N_p\,times}],$$

and perform ML alpha estimate by choosing the top 3 sums, $d_{i,j}(k)|_{j=(1),(2),(3)}$, where j=(1),(2),(3) represent the indices of the 3 possible transmitted sequences that yield the top 3 sum $d_{i,j}(k)$ for a given partitioned sequence k and beam i. Keeping the top three alpha estimates out of 4 from the decision metric $d_{i,j}(k)|_{j=1}^{4}$ maximizes the likelihood of good alpha estimate in the presence of jammers. Then each of the top 3 decision metrics are scaled to get the top 3 alpha estimates of the partitioned sequence which are output by MLEs 126 as given by equation (10):

$$\tilde{\underline{\alpha}}_i(k) = \tilde{\alpha}_{i,j}(k)\,|_{j=(1),(2),(3)} = \frac{1}{(N_{ref}+N_p)}d_{i,j}(k)\,|_{j=(1),(2),(3)}, \tag{10}$$

where $N_p$ is the length of the partitioned sequence. Next, the linear average of the top three alpha estimates of the partitioned sequence is determined to be the alpha estimate for the partitioned sequence k as shown by equation (11):

$$\hat{\alpha}_i(k) = \frac{1}{3}\sum_j \tilde{\alpha}_{i,j}(k)\,|_{j=(1),(2),(3)}. \tag{11}$$

The ML alpha estimation operation is repeated for all k and beam i. The alpha estimate for beam i is the output of the Alpha Quality Estimator (AQE) 130, that takes the alpha estimator for the partitioned sequence, $$\hat{\alpha}_i(k)\,|_{k=1}^{\frac{N_{data}}{N_p}},$$

and the Symbol Quality Estimator (SQE) 102 output, $\underline{I}_{sym}$, as shown in Equation (16) discussed below, with the output $$\hat{\alpha}_i = AQE\left(\hat{\alpha}_i(k)\big|_{k=1}^{\frac{N_{data}}{N_p}}, I_{sym}\right). \tag{12}$$

The alpha estimate for beam i is calculated according to Equation (18) shown below. An example of the ML alpha estimate showing SDPSK 2+40 mode for a given beam i is shown in FIG. 16, where the MLEs 126 perform the following as described above:

$$d_{i,j}(k)\big|_{j=1}^{4} = \hat{\alpha}_{i,ref} + \hat{\alpha}_{i,j}(k)\big|_{j=1}^{4},\ k = 1, \ldots, 20$$

$$d_{i,j}(k)\big|_{j=(1),(2),(3)} = \text{top 3 of the set } d_{i,j}(k)\big|_{j=1}^{4},$$

$$\underline{\tilde{\alpha}}_i(k) = \frac{1}{(N_{ref} + N_p)} d_{i,j}(k)\Big|_{j=(1),(2),(3)},\ k = 1, \ldots, 20$$

Symbol Quality Estimator

Figure 17:
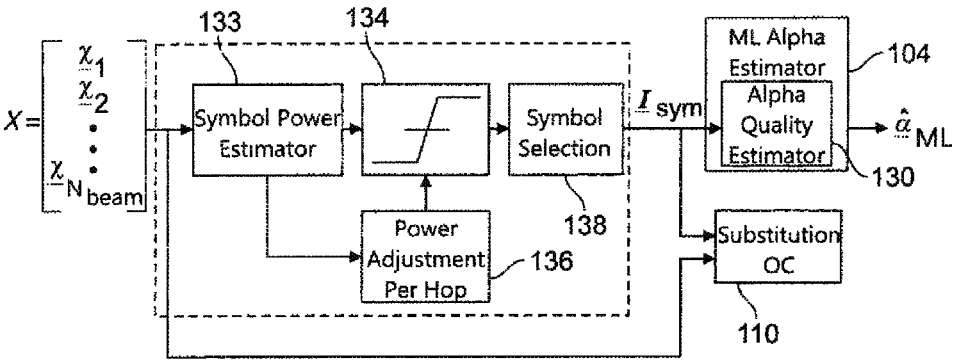
FIG. 17 is a representation of the Signal Quality Estimator of FIG. 15.

Symbol Quality Estimator 102 of FIG. 15 is shown in more detail in FIG. 17. SQE 102 is a statistical estimator used to detect jammed symbols for high quality symbols estimation. It uses the statistics of the received symbol power to eliminate severely jammed symbols or outliers thus preserving high quality symbols for this beam-combining processing. The estimator takes symbol power measurement in each hop, computes the statistics of the symbol power measurement, sets up a threshold dynamically in each hop, and compares it with the symbol power measurement to determine outliers, as shown in FIG. 17. High quality symbols are then preserved in each hop for each beam and symbol selection is done in a statistical manner such that high quality symbols over all beams are compared for a high confidence symbol selection.

An abnormally high power of a received symbol can indicate either a momentary blip or the presence of a jamming signal. The power adjustment is done on a per hop basis by element 136. For each beam i, the apparatus of FIG. 17 finds the median of the symbol power per hop in element 133, and computes a threshold power by element 136 according to equation (13)

$$\sigma_{r,i,th}^2 = med(\text{abs}(\underline{x}_i^2)) + \gamma std(\text{abs}(\underline{x}_i^2)), \tag{13}$$

where $\gamma$ is a constant. An alternate approach for calculating the threshold for beam i is $\sigma_{r,i,th}^2 = E[p_{\underline{x}_i}(l_{80}:l_{97}]$, where $$\underline{p}_{x_i} = \text{sort}(\text{abs}(\underline{x}_i)),\ l_{80} = \lceil 0.8 \cdot N \rceil,\ l_{97} = \lceil 0.9 \cdot N \rceil.$$

The symbol power estimate output by element 133 is compared with the threshold power calculated by element 136. Symbols per beam are chosen by element 134 as shown in equation (14):

$$I_i(\sigma_{r(l),i}^2) = \begin{cases} 1, & \sigma_{r(l),i}^2 < \sigma_{r,i,th}^2 \\ 0, & \sigma_{r(l),i}^2 \geq \sigma_{r,i,th}^2 \end{cases} \tag{14}$$

for l=1, . . . , N where $N = N_{ref} + N_{data}$ and for beam i, where $\sigma_{r,(l),i}^2 = |x_i(l)^2|$ is the symbol power estimate output by element 133.

The symbol selection in element 138 is based on the estimated high quality symbols for all beams and makes a majority rule decision as $$I(\sigma_{r(l)}^2) = \begin{cases} 0, & \frac{1}{N_{beam}} \sum_{i=1}^{N_{beam}} I_i(\sigma_{r(l),i}^2) < 0.5 \\ 1, & \frac{1}{N_{beam}} \sum_{i=1}^{N_{beam}} I_i(\sigma_{r(l),i}^2) \geq 0.5 \end{cases}, \text{ for } l = 1, \ldots, N. \tag{15}$$

To ensure that reference symbols are chosen, the symbol selection in element 138 is updated as $$I_{sym}(l) = \begin{cases} 1, & l \in \{1, \ldots, N_{ref}\} \\ I(\sigma_{r(l)}^2), & l \in \{N_{ref} + 1, \ldots, N\} \end{cases}, \text{ for all beams,} \tag{16}$$

where a symbol number l is selected when the indicator function $I_{sym}(l)=1$. AQE 130 of FIG. 16 receives the symbol selection as a input and selects a high quality alpha estimate as $$I_\alpha(k) = \begin{cases} 1, & I_{sym}(l_{odd} + N_{ref}) I_{sym}(l_{odd} + N_{ref} + 1) = 1 \\ 0, & I_{sym}(l_{odd} + N_{ref}) I_{sym}(l_{odd} + N_{ref} + 1) = 0 \end{cases}, \tag{17}$$

$$\text{where } k = \frac{l_{odd} + 1}{N_p},\ k \in \left\{1, 2, \ldots, \frac{N_{data}}{N_p}\right\} \text{for } l_{odd} \in \{1, 3, \ldots, N_{data} - 1\}.$$

The alpha estimator indicator function in Equation (17) shows that alpha estimator number k is selected when $l_\alpha(k)=1$ where the alpha estimator $\underline{\alpha}_i(k)$ is given in Equation (11) for $$k \in \left\{1, \ldots, \frac{N_{data}}{N_p}\right\}.$$

The alpha estimator for beam i with AQE 130 of FIG. 16 is updated from Equation (12) to be $$\hat{\alpha}_i = \frac{1}{\sum_k I_\alpha(k)} \sum_{k=1}^{\frac{N_{data}}{N_p}} I_\alpha(k) \hat{\alpha}_i(k). \tag{18}$$

The ML alpha estimator is therefore $$\hat{\alpha}_{ML} = \hat{\alpha}_i\big|_{i=1}^{N_{beam}} = \begin{bmatrix} \hat{\alpha}_1 \\ \hat{\alpha}_2 \\ \vdots \\ \hat{\alpha}_{N_{beam}} \end{bmatrix} \tag{19}$$

Substitution OC

Figure 18:
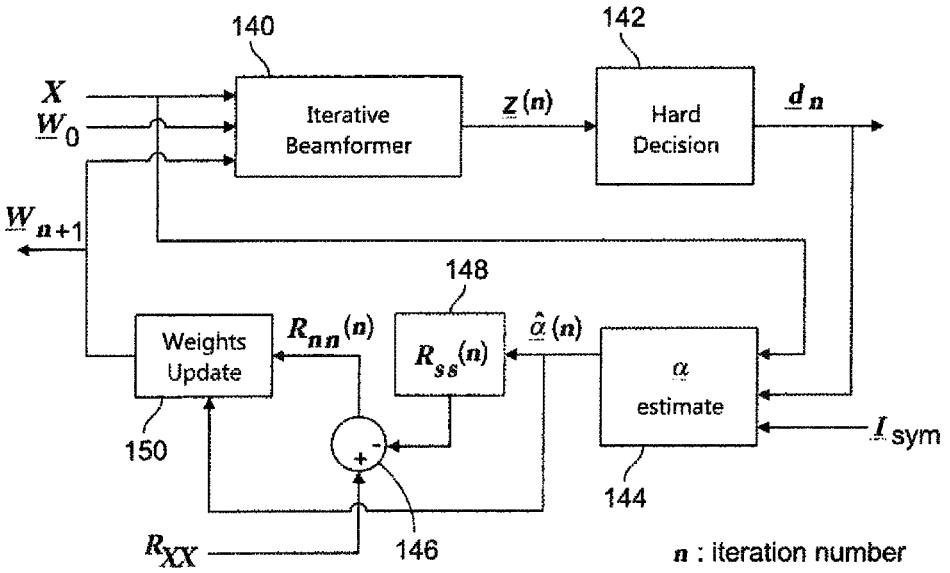
FIG. 18 is a representation of a Substitution OC processor of FIG. 15.

Substitution OC element 110 of FIG. 15 is shown in more detail in FIG. 18. As shown in FIG. 18, the Substitution OC method is iterative with good initial weights such that an optimal set of weights is determined within a few iterations. The direct substitution method is utilized such that given an initial weight vector $\underline{w}_0$, the iteration is $$\underline{w}_{n+1} = f(\underline{w}_n), \text{ for } n \geq 0. \tag{20}$$

To ensure that the Substitution OC method converges to a near optimal solution, a good starting set of weights is required. The ML Alpha Estimator 104 and SQE 102 of FIG. 15 determine the alpha estimates that are good matches for the covariance matrix $\hat{R}_{XX}$ by element 106 of FIG. 15, producing a good initial OC weight vector.

The initial weights without noise loading are calculated according to equation (21)

$$\underline{w}_0(\text{no noise loading})=R_{XX}^{-1}\hat{\underline{\alpha}}_{ML}, \tag{21}$$

where the covariance matrix $$106\ \hat{R}_{XX}=\frac{1}{N}XX^H$$

of FIG. 17 is determined from the received symbols X in equation (1) using a Hermitian matrix of X and $\hat{\underline{\alpha}}$ML is obtained from Equation (19) for all beams. Since the diagonal elements of the covariance matrix are not well-conditioned due to jammers, inverting the matrix would have both large and small eigenvalues, making the weights in (21) very sensitive to errors in $\hat{\underline{\alpha}}_{ML}$. Diagonal noise loading is used on the covariance matrix to alleviate this issue since diagonal noise loading prevents eigenvalues that are too small.

In preferred embodiments according to the present invention using the antenna architectures described above in connection with FIGS. 9-10, i.e., GDA, phased array antenna, combinations of GDA and phased array beams, the co-pending application adaptive beamforming method is modified by using a different equation for dynamic noise loading in the initial weights calculation:

$$nl=c_{nl}\frac{R_{xx_diag_sort}(1)+R_{xx_diag_sort}(2)}{R_{xx_diag_sort}(N_{beam}-1)+R_{xx_diag_sort}(N_{beam})}, \tag{22}$$

where $R_{xx_diag_sort}$=sort(diag($\hat{R}_{XX}$), descend), $c_{nl}$ is a constant, $N_{beam}$=number of antenna beams, $R_{xx_diag_sort}$ contains the diagonal elements of $\hat{R}_{XX}$ in descending order, and $N_{beam}\geq 3$.

Another method of calculating the dynamic noise loading in the initial weights calculation for the preferred embodiments of the invention is to perform the following using the QR decomposition:

$$\hat{R}_{XX}=QR, \tag{23}$$

$$nl=c_{nl}\frac{R_{diag_sort}(1)\cdot R_{diag_sort}(N_{beam})}{std(\text{diag}(\hat{R}_{XX}))}, \tag{24}$$

where $R_{diag_sort}$=sort(abs(diag(R)), descend), $c_{nl}$ is a constant, $N_{beam}$=number for antenna beams, $R_{diag_sort}$ contains the diagonal elements of R in descending order, and $N_{beam}\geq 3$.

Returning to a discussion of the adaptive beamforming algorithm of the copending application, the updated covariance matrix 106 of FIG. 15 is then given be equation (25):

$$R_{XX}=\hat{R}_{XX}+nl\ I, \tag{25}$$

where I is a $N_{beam}\times N_{beam}$ identity matrix scaled by noise loading factor nl and $N_{beam}$ is the number of beams. Given the estimated covariance matrix with DNL, and the ML alpha estimate, $\hat{\underline{\alpha}}_{ML}$, the initial estimate of weights 108 of FIG. 15 is calculated using optimal combining $$\underline{w}_0=R_{XX}^{-1}\hat{\underline{\alpha}}_{ML}. \tag{26}$$

A good initial set of weights calculated using ML alpha estimate and covariance matrix with DNL, are used for the iterative Substitution OC Method which further refines the weights for SNR optimization.

The Substitution OC Method 110 of FIG. 15 is an iterative method that, with good initial weights from Equation (26), will converge to a unique and near-optimal solution for beamformer weights in a few iterations. As shown in FIG. 18, where the $\underline{\alpha}$ estimate and weights are updated every iteration, $I_{sym}$ is a vector of the indicator function (16) that comes from the SQE 102 of FIG. 15. Initial weights $\underline{w}_0$ are input to Iterative Beamformer 140 which uses weights $\underline{w}_n$ for subsequent iterations to output $\underline{z}(n)$ according to equation (32) below. Hard Decision logic 142 calculates $\underline{d}_n$ in accordance with equations (30) and (31) below. The result, together with input symbols X and the high quality indicator vector $I_{sym}$ are input into the $\underline{\alpha}$ estimator 144 which determines $\hat{\underline{\alpha}}(n)$ in accordance with equation (27) which further refines the estimate in each iteration. Logic 144 provides an input to logic 148 which calculates the signal covariance matrix $R_{ss}(n)$ in accordance with equation (33). This result is added to $R_{XX}$ in adder 146 then provided to weights update logic 150, which executes equation (28). Assuming $\underline{d}(t)$ is uncorrelated with $\underline{J}(t)$ and $\underline{n}(t)$, then the $\underline{\alpha}$ estimator 144 is shown to make the method converge as long as the Symbol Error (SE)<0.5 according to equation (27):

$$\hat{\underline{\alpha}}=\mathbb{E}\,[\underline{d}(t)^H\underline{x}(t)]\approx\underline{\alpha}(1-2SE). \tag{27}$$

Assuming the transmitted reference symbols $\underline{s}_{ref}$ are known, for SDPSK waveforms, for each iteration n=1, . . . , m, the method uses refined estimates of $\hat{\underline{\alpha}}$, $R_{ss}$ and $R_{nm}$ to update the weights as $$\underline{w}_{n+1}=g(R_{ss}(n),R_{nn}(n),\hat{\underline{\alpha}}(n),\underline{w}_n)=R_{nn}(n)^{-1}\hat{\underline{\alpha}}(n), \tag{28}$$

where $$\hat{\underline{\alpha}}(n)=\frac{1}{I_{sym}I^T}\left[X(:,I_{sym})\underline{d}(:,I_{sym})_n^H\right], \tag{29}$$

$$\underline{I}=[1,\ldots,1]_{1\times N},$$

$$\underline{d}_n=[\underline{s}_{ref}\underline{d}_{data}(n)], \tag{30}$$

$$\underline{d}_{data}(n)=\begin{cases}\text{sgn}[\text{Re}(z_k(n))], & k\ \text{odd},\ k\geq N_{ref}+1\\ i\ \text{sgn}[\text{Im}(z_k(n))], & k\ \text{even},\ k\geq N_{ref}+1\end{cases}, \tag{31}$$

$$\text{sgn}(u)=\begin{cases}-1, & u<0\\ 1, & u\geq 0\end{cases},$$

$$\underline{z}(n)=[z_1,\ldots,z_N](n)=\begin{cases}\underline{w}_0^H X, & n=1\\ \underline{w}_n^H X, & n=2,\ldots,m\end{cases}, \tag{32}$$

$$R_{ss}(n)=\hat{\underline{\alpha}}(n)\hat{\underline{\alpha}}(n)^H, \tag{33}$$

$$R_{nn}(n)=R_{XX}-R_{ss}(n), \tag{34}$$

where X is a $N_{beam}$×N matrix of the received samples and n is the iteration number. At the end of iteration m, the weights are normalized by the maximum of the weights magnitude.

The iterative method refines the $\underline{\alpha}$ estimate, $R_{nm}$, thus the beam-combining weights every iteration, converging to a set of optimal weights for a given user while maintaining implementable HW complexity.

Post Iterative Beamformer

Post Iterative Beamformer 112 of FIG. 15 uses the results of the iterative substitution method with beam combining weights optimized for each user in theater $$\underline{y}=\Sigma_{i=1}^{N_{beam}} w_i^* \underline{x}_i, \tag{35}$$

where $N_{beam}$ is the number of beams, $\underline{x}_i$ is the row vector from beam i of X, $w_i^*$ is the beam combining weight for a given hop and $\underline{y}$ is the combined beam. Moreover, $$\underline{w}_m = [w_1, \ldots, w_{Nbeam}]^T$$

is the weight vector from the Substitution OC method. The beamformer combines the received symbols with adaptive weights that optimize the user SNR while the impacts of jammer and interference are minimized at the same time. The beamformed output signal $\underline{y}$ is clear of jammer impacts and can be demodulated easily.

Figure 19:
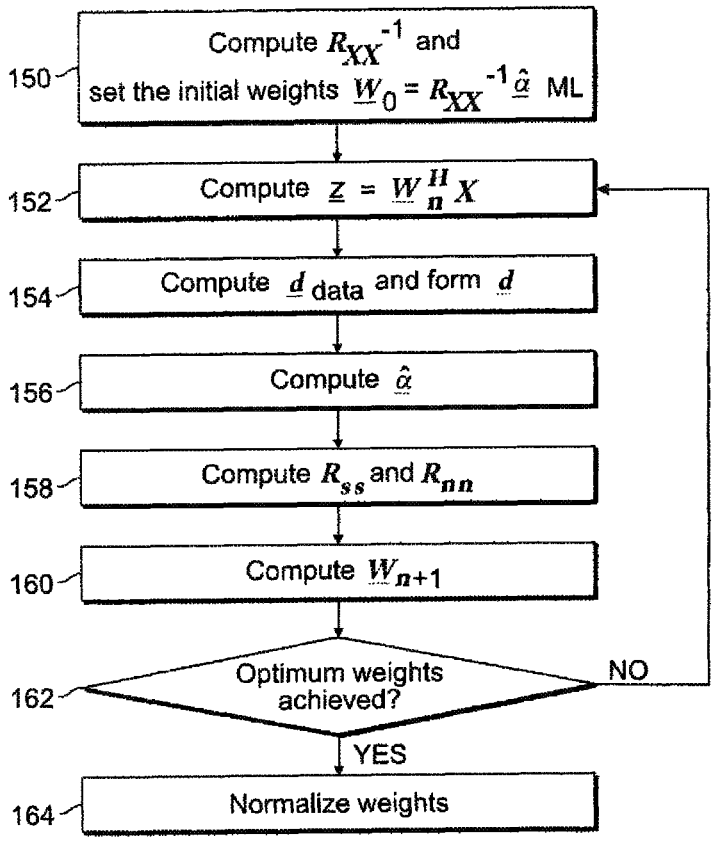
FIG. 19 is a flowchart of a method for digital beamforming using Substitution Optimal Combining.

An implementation of the invention according to a preferred embodiment is shown in FIG. 19. At step 150, $R_{XX}^{-1}$ is computed, where $R_{XX}$ is found according to equation (25), and estimated alpha $\hat{\underline{\alpha}}_{ML}$ is computed according to equation (19), then the initial weight is set according to $\underline{w}_0=R_{XX}^{-1}\hat{\underline{\alpha}}_{ML}$ in equation (26).

Then, beginning with step 152, a set of m iterations per hop is started, and for each iteration, a series of steps are performed. In a preferred embodiment, 3 iterations give an optimal result, but any number of iterations may be used. The device may also detect an end condition instead of being set to a certain number of iterations.

At step 152, the iterative beamformer $\underline{z}=\underline{w}_n^H X$ is computed, where X is a $N_{beam}$×N matrix of the received samples and $\underline{w}_n=\underline{w}_0$ for n=1.

At step 154, two decision metrics:

$$d_{data} = \begin{cases} \text{sgn}[\text{Re}(z_k)], & k \text{ odd}, \quad k \geq N_{ref}+1 \\ i\ \text{sgn}[\text{Im}(z_k)], & k \text{ even}, \quad k \geq N_{ref}+1 \end{cases} \text{ and } \underline{d} = [s_{ref}, d_{data}]$$

are formed where $\underline{s}_{ref}$ is a sequence of known reference symbols.

At step 156, an estimated alpha is computed according to $$\hat{\underline{\alpha}} = \frac{1}{I_{sym} I^T} X(:, I_{sym}) \underline{d}(:, I_{sym})^H, \text{ where } I = [1, \ldots, 1]_{1\times N}.$$

At step 158, values for $R_{ss}$ and $R_{nm}$ are computed in accordance with $R_{ss}=\hat{\underline{\alpha}}\hat{\underline{\alpha}}^H$ and $R_{nn}=R_{XX}-R_{ss}$.

Then, in step 160, a weight vector is computed according to $\underline{w}_{n+1}=R_{nn}^{-1}\hat{\underline{\alpha}}$.

At decision point 162, an end condition for the iterations is checked and, it not met, the process returns to step 152. Otherwise, the process continues to step 162 where the weights are normalized by the maximum of the weights magnitude.

In a preferred embodiment, this approach is developed based on the SDPSK modes of 2+40, 4+80, and 8+160 (number of reference symbols+number of data symbols). It not only performs well under the stressed environment against the full-band noise jammer, partial band jammer, tone jammer and pulse jammer, the performance is near ideal MRC under unstressed environment due to the use of dynamic noise loading. The method is robust in both stressed and unstressed communications.

Figure 20:
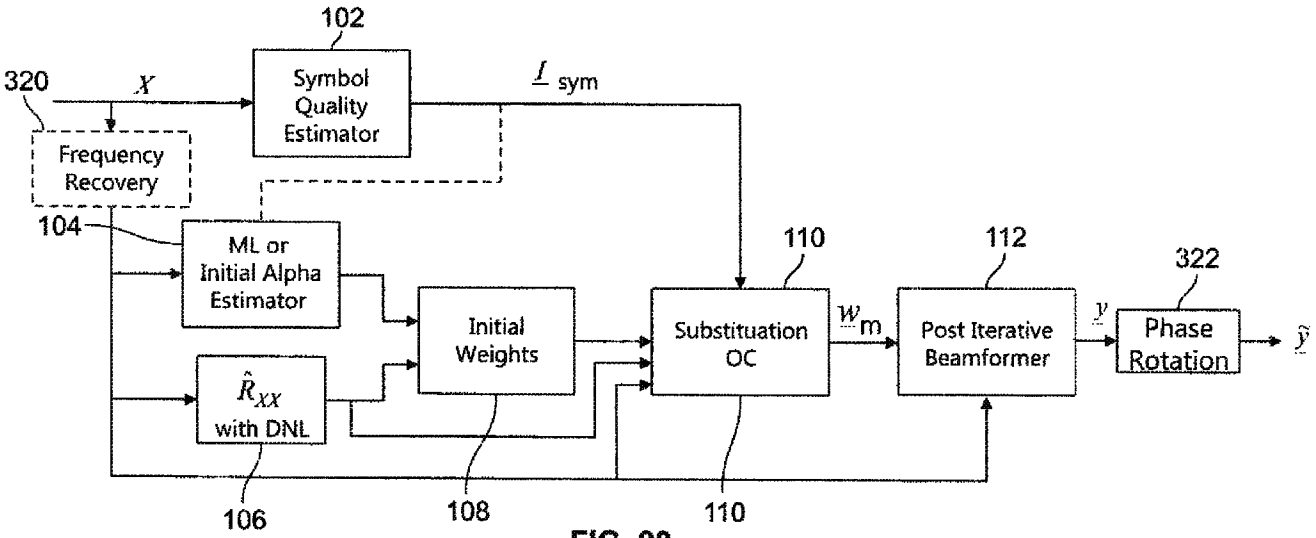
FIG. 20 depicts an apparatus for a digital beamforming algorithm for M-ary PSK waveforms is similar to that of FIG. 15
Figure 21:
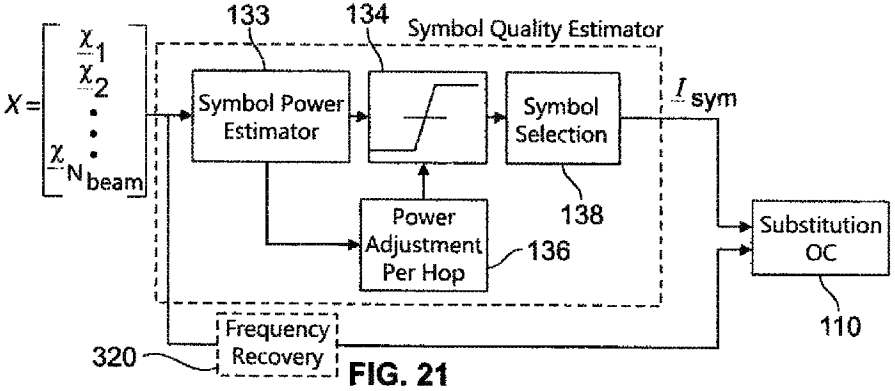
FIG. 21 depicts the Symbol Quality Estimator of FIG. 17, adapted for M-ary PSK waveforms.

The beamforming algorithm of the co-pending application can be applied to other waveforms, coherent or partially coherent, i.e., M-ary PSK waveforms, QPSK, 8PSK, 12-4 QAM, and GMSK for any antenna architectures. The digital beamforming algorithm for M-ary waveforms is similar to that of FIG. 15, modified as shown in FIG. 20, where symbol quality estimator 102 is modified, ML or initial alpha estimator 104 is changed, as well as the substitution OC algorithm 110. Moreover, a phase rotation 322 is done after the post-beamformer to resolve sign ambiguity for M-ary PSK waveforms. Symbol quality estimator 102 is changed in a way that the output, symbol quality indicator, $I_{sym}$, goes only to the Substitution OC algorithm 110 as shown in FIG. 20 and FIG. 21. Frequency recovery 320 can be applied at the received signals X using standard algorithm if needed and it is optional.

The frequency offset or phase drift at the signal bandwidth of the optional frequency recovery algorithm is estimated to be $$\rho_{lead,i} = \frac{\underline{x}_{ref,i,lead} \cdot \underline{s}_{ref,lead}^H}{|\underline{x}_{ref,i,lead} \cdot \underline{s}_{ref,lead}^H|},$$

$$\rho_{trail,i} = \frac{\underline{x}_{ref,i,trail} \cdot \underline{s}_{ref,trail}^H}{|\underline{x}_{ref,i,trail} \cdot \underline{s}_{ref,trail}^H|},$$

$$\gamma = \frac{\rho_{lead}}{\rho_{trail}},$$

$$\tilde{\underline{x}}_i = \underline{x}_i \cdot (\gamma^v)*,$$

$$v = [0, \ldots, 1],$$

where $\underline{x}_{ref,i,lead}$ and $\underline{s}_{ref,lead}$ are leading received reference symbols and leading reference symbols, respectively, whereas, $\underline{x}_{ref,i,trail}$ and $\underline{s}_{ref,trail}$ are trailing received reference symbols and trailing reference symbols, respectively, $\tilde{\underline{x}}_j$ is the output of the frequency recovery, and i is beam number. The exponent, v, weights the multiplier γ at each symbol index to offset the estimated phase drift across the hop.

Maximum Likelihood (ML) Alpha Estimator

Figure 22:
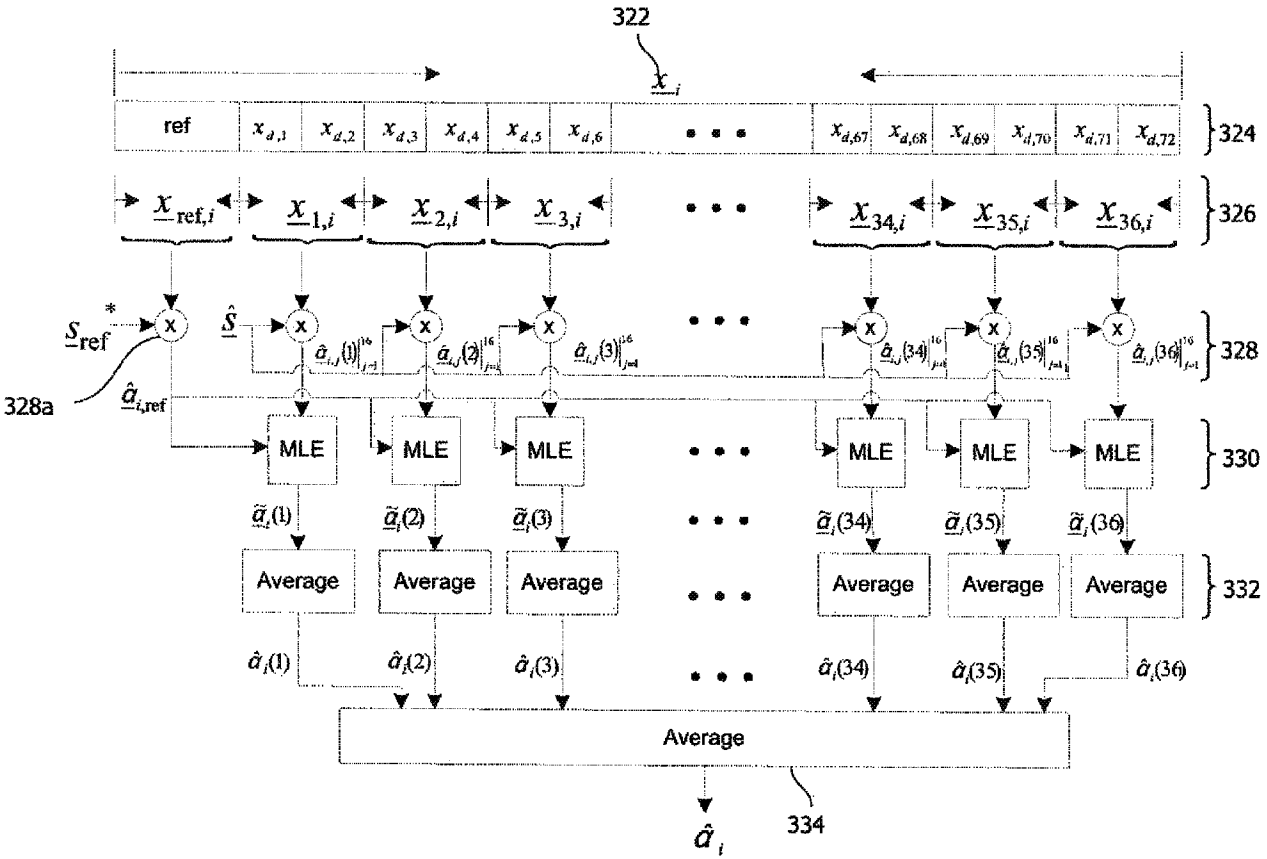
FIG. 22 depicts the ML Alpha Estimator of FIG. 16 modified for M-ary PSK waveforms.

The beam steering vector, $\underline{\alpha}$, for a desired signal is calculated by ML Alpha Estimator 104 of FIG. 20. An example of the ML alpha estimator showing QPSK 5+72 mode (a mode with 5 reference symbols and 72 data symbols) is shown in FIG. 22. Reference numeral 322 indicates complex received symbols $\underline{x}_i$ of a hop for beam i, $$\underline{x}_i=[x_{1,i}, \ldots x_{N,i}],$$

where $N=N_{ref}+N_{data}$, $N_{ref}$ is the number of reference symbols and $N_{data}$ is the number of data symbols. The sequence of received symbols $\underline{x}_i$ 322 is a vector of X for beam i in equation (1).

In order to reduce the complexity of calculating an estimate value for $\underline{\alpha}$, the data portion of the received symbols is partitioned into blocks 324 of length $N_p$ symbols, as illustrated in FIG. 22 at 326, where $N_p=2$ is the length of the partitioned sequence in equation (36), without loss of generality, reference symbols are assumed to be at the beginning of a hop, $$x_i = \begin{bmatrix} \underline{x}_{ref,i}, & \underbrace{\underline{x}_{data,i}}_{\{\underline{x}_{k,i}|_{k=1}^{N_{data}/2}\}} \end{bmatrix} = \left[\underline{x}_{ref,i}, \underline{x}_{1,i}, \ldots, \underline{x}_{N_{data}/2,i}\right], \tag{36}$$

where $\underline{x}_{k,i}$, $k\in\{1, \ldots, N_{data}/2\}$ is a length-$N_p$ or length-2 sequence for partitioned sequence k and beam i. For QPSK or 4-ary PSK (M=4) modulation, the four possible symbol constellations are $$\left\{\left[e^{i\frac{\pi}{4}}, e^{i\frac{\pi}{4}}\right], \left[e^{i\frac{3\pi}{4}}, e^{i\frac{3\pi}{4}}\right], \left[e^{i\frac{5\pi}{4}}, e^{i\frac{5\pi}{4}}\right], \left[e^{-i\frac{\pi}{4}}, e^{-i\frac{\pi}{4}}\right]\right\}.$$

There are $4^{Np}$ ($M_{Np}$) or 16 pairs of the possible transmitted sequence, $$\hat{\underline{s}} = \begin{Bmatrix} \left[e^{i\frac{\pi}{4}}, e^{i\frac{\pi}{4}}\right], \left[e^{i\frac{\pi}{4}}, e^{i\frac{3\pi}{4}}\right], \left[e^{i\frac{\pi}{4}}, e^{i\frac{5\pi}{4}}\right], \\ \left[e^{i\frac{\pi}{4}}, e^{-i\frac{\pi}{4}}\right], \ldots, \left[e^{-i\frac{\pi}{4}}, e^{i\frac{\pi}{4}}\right], \left[e^{-i\frac{\pi}{4}}, e^{i\frac{3\pi}{4}}\right], \\ \left[e^{-i\frac{\pi}{4}}, e^{i\frac{5\pi}{4}}\right], \left[e^{-i\frac{\pi}{4}}, e^{-i\frac{\pi}{4}}\right] \end{Bmatrix},$$

each partitioned sequence. At 328*a*, the partitioned sequence is correlated with each pair of the estimated symbols, $\hat{\underline{s}}$, which provides a set of alpha estimates of the partitioned sequence.

Correlators 328 output the alpha estimates of each partitioned sequence as shown in equation (37):

$$\hat{\underline{\alpha}}_{i,j}(k) = \underline{x}_{k,i} \begin{bmatrix} \hat{s}_j(1)^* & \ldots & 0 \\ \vdots & \ddots & \vdots \\ 0 & \ldots & \hat{s}_j(N_p)^* \end{bmatrix}, \tag{37}$$

where $k=1, \ldots, N_{data}/2$, $j=1, \ldots, 4^{Np}$, i is the beam number, $N_p=2$, and $\hat{\underline{s}}=\{\hat{\underline{s}}_j|_{j=1}^{16}\}$. Given the known transmitted reference symbols $\underline{s}_{ref}=[s_{ref}(1), \ldots, s_{ref}(N_{ref})]$ of length $N_{ref}$, the alpha estimate for the received reference sequence is output from correlator 128*a* as $$\hat{\underline{\alpha}}_{i,ref} = \underline{x}_{ref,i} \begin{bmatrix} s_{ref}(1)^* & \ldots & 0 \\ \vdots & \ddots & \vdots \\ 0 & \ldots & s_{ref}(N_{ref})^* \end{bmatrix}. \tag{38}$$

A decision metric is calculated by MLEs 330 using equation (39):

$$d_{i,j}(k)=\text{sum}[\hat{\underline{\alpha}}_{i,ref}\hat{\underline{\alpha}}_{i,j}(k)]=\hat{\underline{\alpha}}_{i,ref}\underline{I}_{N_{ref}}{}^t+\hat{\underline{\alpha}}_{i,j}(k)I_{N_p}{}^t, \text{ for } j=1, \ldots, M^{Np}, M=4, \tag{39}$$

where $$I_{N_{ref}} = [\underbrace{1 \ldots 1}_{N_{ref}\,times}], I_{N_p} = [\underbrace{1 \ldots 1}_{N_p\,times}],$$

and perform ML alpha estimate by choosing the top 15 or $M^{Np}-1$ sums, $d_{i,j}(k)|_{j=(1), \ldots, (M^{Np}-1)}$, where $j=(1), \ldots, (M^{Np}-1)$ represent the indices of the $M^{Np}-1$ possible transmitted sequences that yield the top 15 or $M^{Np}-1$ sum $d_{i,j}(k)$ for a given partitioned sequence k and beam i. Keeping the top $M^{Np}-1$ alpha estimates out of $M^{Np}$ from the decision metric $d_{i,j}(k)|_{j=1}^{M^{Np}}$ maximizes the likelihood of good alpha estimate in the presence of jammers. Then each of the top $M^{NP}-1$ decision metrics are scaled to get the top $M^{Np}-1$ alpha estimates of the partitioned sequence which are output by MLEs 330 as given by equation (40):

$$\tilde{\underline{\alpha}}_i(k) = \tilde{\alpha}_{i,j}(k)\Big|_{j=(1), \ldots, (M^{N_p}-1)} = \frac{1}{(N_{ref}+N_p)} d_{i,j}(k)\Big|_{j=(1), \ldots, (15)} \tag{40}$$

where $N_p$ is the length of the partitioned sequence. Next, the linear average of the top $M^{Np}-1$ alpha estimates of the partitioned sequence is determined to be the alpha estimate for the partitioned sequence k as shown by equation (41):

$$\hat{\alpha}_i(k) = \frac{1}{M^{N_p-1}} \sum_j \tilde{\alpha}_{i,j}(k)\Big|_{j=(1), \ldots, (M^{N_p-1})} \tag{41}$$

An example of the ML alpha estimate showing QPSK 5+72 mode for a given beam i is shown in FIG. 22, where the MLEs 330 perform the following as described above:

$$d_{i,j}(k)\Big|_{j=1}^{M^{N_p}} = \hat{\underline{\alpha}}_{i,ref} + \hat{\underline{\alpha}}_{i,j}(k)\Big|_{j=1}^{16}, k = 1, \ldots, 36, M^{N_p} = 4^2 = 16,$$

$$d_{i,j}(k)|_{j=(1), \ldots, (15)} = \text{top 15 or } (M^{N_p}-1) \text{ of the set } d_{i,j}(k)|_{j=1}^{16},$$

$$\tilde{\underline{\alpha}}_i(k) = \frac{1}{N_{ref}+N_p} d_{i,j}(k)\Big|_{j=(1), \ldots, (15)}, k = 1, \ldots, 36.$$

The ML alpha estimation operation is repeated for all k and beam i. The alpha estimator for beam i becomes $$\hat{\alpha}_i = E\left[\left\{\hat{\alpha}_i(1), \hat{\alpha}_i(2), \ldots, \hat{\alpha}_i\left(\frac{N_{data}}{N_p}\right)\right\}\right], \text{where } E\ [\cdot]$$

is linear average. The ML alpha estimator 334 therefore gives a result of:

$$\hat{\underline{\alpha}}_{ML} = \hat{\underline{\alpha}}_i\,|_{i=1}^{N_{beam}} = \begin{bmatrix} \hat{\alpha}_1 \\ \hat{\alpha}_2 \\ \vdots \\ \hat{\alpha}_{N_{beam}} \end{bmatrix}. \tag{42}$$

Initial Alpha Estimate

Figure 23:
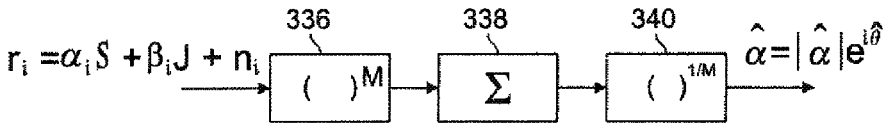
FIG. 23 depicts a flow chart showing a simple estimation process for initial alpha estimate calculation.

Initial alpha estimate is done either through the ML alpha estimator as given as an example in FIG. 22, or alternate schemes are implemented for higher order modulation, M-ary PSK, to reduce complexity in hardware implementation for the ML alpha estimate. For M-ary PSK, M≥8, an approach for the initial alpha estimate is calculated through simple estimation equation as shown in FIG. 23, where the received signal for each beam is raised to the power of M at 336, summed at 338, and then taken to the power of 1/M at 340. The sign of the phase of the alpha estimate is then resolved through known reference symbols. Another approach for initial alpha estimate is calculated based on the reference symbols as $$\hat{\alpha}_i = \frac{x_{ref,i} \cdot s_{ref}^H}{N_{ref}} \text{ for beam } i, \tag{43}$$

where $\underline{s}_{ref}=[s_{ref}(1), \ldots, s_{ref}(N_{ref})]$ are known reference symbols.

Symbol Quality Estimator

Symbol quality estimator is changed in a way that the output, symbol quality indicator, $I_{sym}$, goes only to the Substitution OC algorithm as shown in FIG. 20 and FIG. 21, while the content of the technique is unchanged.

The initial weights without noise loading are calculated as $$\underline{w}_0(\text{no noise loading}) = \hat{R}_{XX}^{-1}\hat{\underline{\alpha}}_{ML}, \tag{44}$$

where the covariance matrix 106

$$\hat{R}_{XX} = \frac{1}{N}XX^H$$

of FIG. 20 is determined from the received symbols X in equation (1) using a Hermitian matrix of X and $\hat{\underline{\alpha}}_{ML}$ is obtained from Equation (42) for all beams. Since the diagonal elements of the covariance matrix are not well-conditioned due to jammers, inverting the matrix would have both large and small eigenvalues, making the weights in (44) very sensitive to errors in $\hat{\underline{\alpha}}_{ML}$. Diagonal noise loading is used on the covariance matrix to alleviate this issue since diagonal noise loading prevents eigenvalues that are too small.

The dynamic noise loading is done on the diagonal elements of the covariance matrix $\hat{R}_{XX}$, as shown by element 106 of FIG. 20 at every hop. The minimum of the diagonal elements of the covariance matrix is calculated, the standard deviation of the diagonal elements is determined, and the noise loading for an MBA system is found to be $$nl = c_{nl}\frac{\min(\text{diag}(\hat{R}_{XX}))}{std(\text{diag}(\hat{R}_{XX}))},$$

where $c_{nl}$ is a constant. In embodiments using the antenna architectures, i.e., GDA array, phased array antenna beams, combinations of GDA and phased array beams, a different equation for dynamic noise loading in the initial weights calculation is used:

$$nl = c_{nl}\frac{R_{xx_diag_sort}(1) + R_{xx_diag_sort}(2)}{R_{xx_diag_sort}(N_{beam}-1) + R_{xx_diag_sort}(N_{beam})},$$

where $R_{xx_diag_sort}$=sort(diag($\hat{R}_{XX}$), descend), $c_{nl}$ is a constant, $N_{beam}$=number of antenna beams, $R_{xx_diag_sort}$ contains the diagonal elements of $\hat{R}_{XX}$ in descending order, and $N_{beam}$≥3.

The updated covariance matrix 106 of FIG. 20 is then given be equation (45):

$$R_{XX}=\hat{R}_{XX}+nl\ I, \tag{45}$$

where I is a $N_{beam}\times N_{beam}$ identity matrix scaled by noise loading factor nl and $N_{beam}$ is the number of beams. Given the estimated covariance matrix with DNL, and the ML alpha estimate, $\hat{\underline{\alpha}}_{ML}$, the initial estimate of weights 108 of FIG. 20 is calculated using optimal combining as $\underline{w}_0=R_{XX}^{-1}\hat{\underline{\alpha}}_{ML}$.

Another approach to finding the initial weights estimate is to use the initial alpha estimate as stated above in connection with equation (43), to be $\underline{w}_0=R_{XX}^{-1}\hat{\underline{\alpha}}$.

Substitution OC

Figure 24:
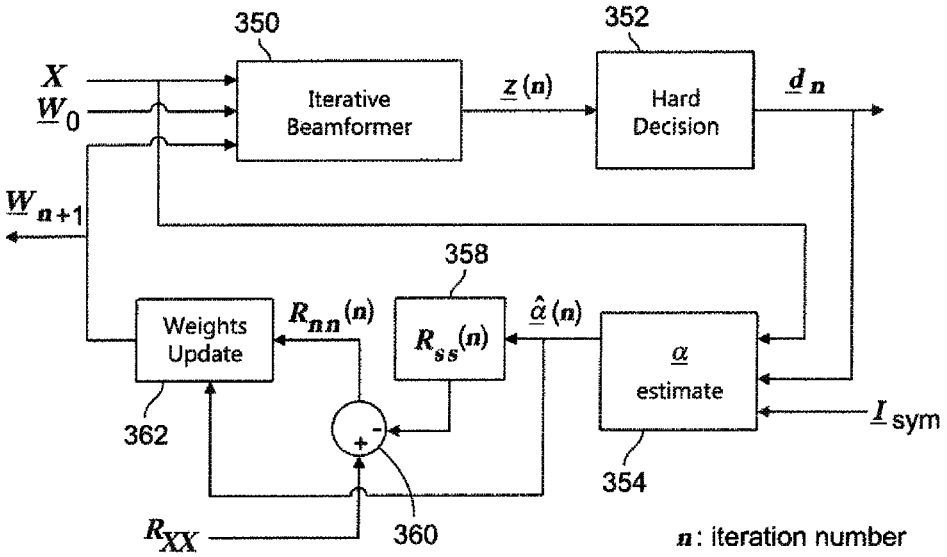
FIG. 24 depicts Substitution OC element 110 of FIG. 20.

Substitution OC element 110 of FIG. 20 is shown in more detail in FIG. 24. As shown in FIG. 24, the Substitution OC method is iterative with good initial weights such that an optimal set of weights is determined within a few iterations. The direct substitution method is utilized such that given an initial weight vector $\underline{w}_0$, the iteration is $$\underline{w}_{n+1}=f(\underline{w}_n), \text{ for } n\geq 0$$

As shown in FIG. 24, where the $\underline{\alpha}$ estimate and weights are updated every iteration, $I_{sym}$ is a vector of the indicator function that comes from the SQE 102 of FIG. 20. Initial weights $\underline{w}_0$ are input to Iterative Beamformer 350 which uses weights $\underline{w}_n$ for subsequent iterations to output $e\underline{z}(n)$ according to equation (51) below. Hard Decision logic 352 calculates $\underline{d}_n$ in accordance with equations (49) and (50) below. The result, together with input symbols X and the high quality indicator vector $I_{sym}$ are input into the $\underline{\alpha}$ estimator 354 which determines $\underline{\alpha}(n)$ in accordance with equation (46) which further refines the estimate in each iteration. Alpha Estimate Logic 354 provides an input to logic 358 which calculates the signal covariance matrix $R_{ss}(n)$ in accordance with equation (52). This result is added to $R_{XX}$ in adder 360 then provided to weights update logic 362, which executes equation (47).

$$\hat{\underline{\alpha}}=\mathbb{E}\,[\underline{d}(t)^H\underline{x}(t)] \tag{46}$$

Assuming the transmitted reference symbols $\underline{s}_{ref}$ are known for M-ary PSK waveforms, for each iteration n=1, . . . , m, the method uses refined estimates of $\hat{\underline{\alpha}}$, $R_{ss}$ and $R_{nn}$ to update the weights as $$\underline{w}_{n+1}=g(R_{ss}(n),R_{nn}(n),\hat{\underline{\alpha}}(n),\underline{w}_n)=R_{nn}(n)^{-1}\hat{\underline{\alpha}}(n), \tag{47}$$

where $$\hat{\underline{\alpha}}(n) = \frac{1}{I_{sym}I^T}\left[X(:, I_{sym})\underline{d}(:, I_{sym})_n^H\right], \tag{48}$$

$$\underline{I} = [1, \ldots, 1]_{1\times N},$$

$$\underline{d}_n=[\underline{s}_{ref}\underline{d}_{data}(n)] \tag{49}$$

$$\underline{d}_{data}(n)=\arg\min_{s_{psk}(h)}|z_k(n)-s_{psk}(h),\quad h=1,\ldots,M, k\in\{\text{data symbol index}\}, s_{psk}(h)\in\{M\text{-ary PSK symbols}\}, \tag{50}$$

$$z(n)=[z_1,\ldots,z_N](n)=\begin{cases}\underline{w}_0^H X, & n=1\\ \underline{w}_n^H X, & n=2,\ldots,m\end{cases}, \tag{51}$$

$$R_{ss}(n)=\hat{\underline{\alpha}}(n)\hat{\underline{\alpha}}(n)^H, \tag{52}$$

$$R_{nn}(n)=R_{XX}-R_{ss}(n), \tag{53}$$

where X is a $N_{beam}\times N$ matrix of the received samples and n is the iteration number. At the end of iteration m, the weights are normalized by the maximum of the weights magnitude.

The substitution OC algorithm just shown is unchanged from the co-pending application and described in connection with FIG. 18 of this application, except for the way the hard decision function works. The hard decision function makes a hard decision on the iterative beamformer output based on the M-ary PSK symbols, basically finding the symbol with the minimum distance to the M-ary symbols, $$\underline{d}_{data}(n)=\arg\min_{s_{psk}(h)}|z_k(n)-s_{psk}(h)|,\quad h=1,\ldots,M, k\in\{\text{data symbol index}\},$$

where $s_{psk}(h)\in$(M-ary PSK symbols). The hard decision output is then given as $$\underline{d}_n=[\underline{s}_{ref},\underline{d}_{data}(n)],$$

where $\underline{s}_{ref}$ is a sequence of reference symbols.

Post Iterative Beamformer

Post Iterative Beamformer 112 of FIG. 20 uses the results of the iterative substitution method with beam combining weights optimized for each user in theater $$\underline{y}=\Sigma_{i=1}^{N_{beam}} w_i^* x_i, \tag{54}$$

where $N_{beam}$ is the number of beams, $\underline{x}_i$ is the row vector from beam i of X, $w_i^*$ is the beam combining weight for a given hop and $\underline{y}$ is the combined beam. Moreover, $$\underline{w}_m=[w_1,\ldots,w_{Nbeam}]^T$$

is the weight vector from the Substitution OC method.

Phase Rotation

Phase estimate is done to avoid the sign change or ±180' rotation on the post-beamformer output as $$\hat{\theta}=\text{angle}\{E[\underline{y}(1,2,\ldots,N_{ref})^H s_{ref}]\}, \tag{55}$$

$$\hat{\underline{y}}=\begin{cases}\underline{y}, & |\hat{\theta}|<\frac{\pi}{M}\\ \underline{y}\cdot e^{-i\hat{\theta}}, & \text{otherwise}\end{cases},$$

where M is the number of symbols for M-ary PSK waveforms and E[•] is the linear average.

Figure 27:
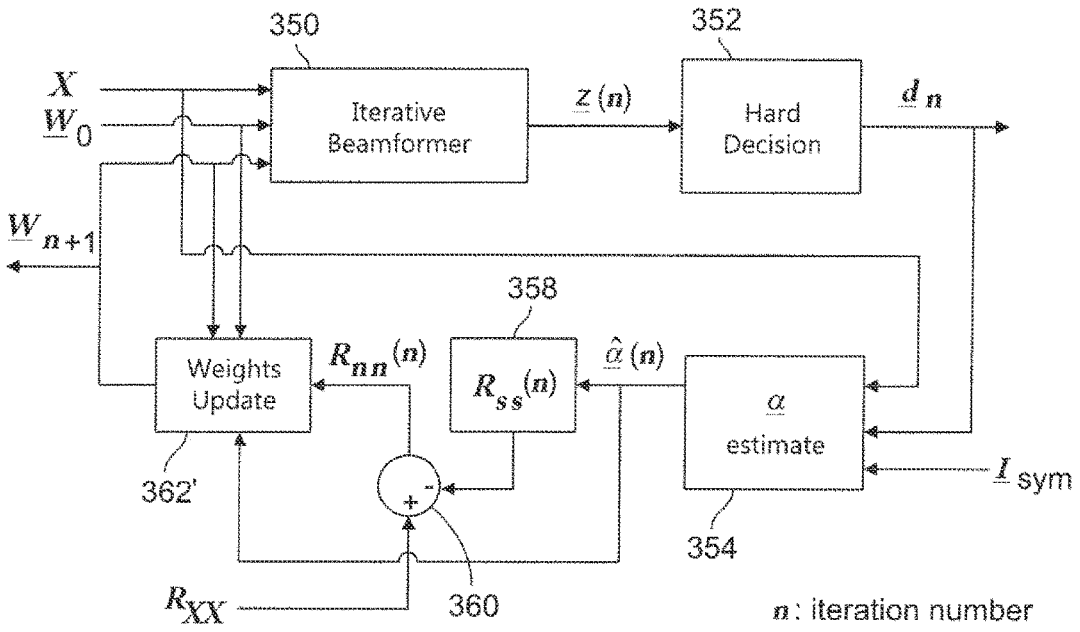
FIG. 27 depicts a further embodiment of Substitution OC element 110 of FIG. 20.

In an alternative embodiment, a different method is used in place of the Substitution OC method. Instead, a Substitution-SNR method shown in FIG. 27 is used to update beamformer weights using the SNR equation.

$$\underline{w}_{n+1}=\frac{\underline{w}_n^H R_{nn}(n)\underline{w}_n}{\underline{w}_n^H R_{ss}(n)\underline{w}_n}R_{nn}^{-1}(n)R_{ss}(n)\underline{w}_n,$$

$$\text{where } \underline{w}_n=\begin{cases}\underline{w}_0, & n=1\\ \underline{w}_n, & n=2,\ldots,m\end{cases}$$

The Substitution-SNR method is unchanged from the co-pending application except the way that the hard decision works. The hard decision function makes a hard decision on the iterative beamformer output based on the M-ary PSK symbols, basically finding the symbol with the minimum distance to the M-ary symbols, $$\underline{d}_{data}(n)=\arg\min_{s_{psk}(h)}|z_k(n)=s_{psk}(h)|,$$

$$h=1,\ldots M, k\in\{\text{data symbol index}\},$$

where $s_{psk}(h)\in\{$M-ary PSK symbols$\}$. The hard decision output is then given as $$\underline{d}_n=[\underline{s}_{ref},\underline{d}_{data}(n)],$$

where $\underline{s}_{ref}$ is a sequence of reference symbols.

Figure 25A:
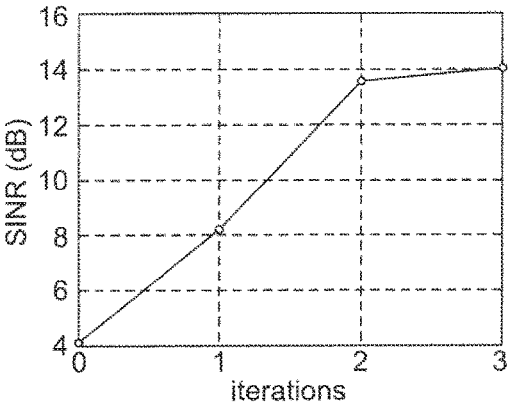
FIGS. 25A-25H depict the performance of the invention according to an embodiment.
Figure 25H:
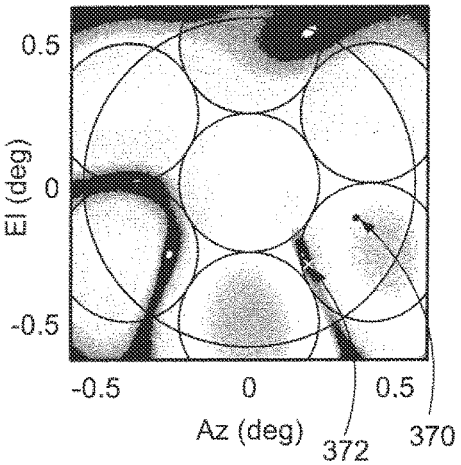
Figure 25B:
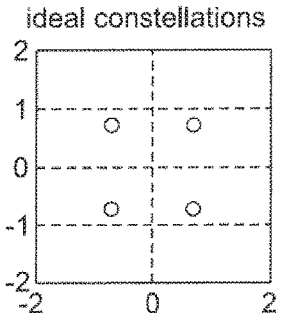
Figure 25C:
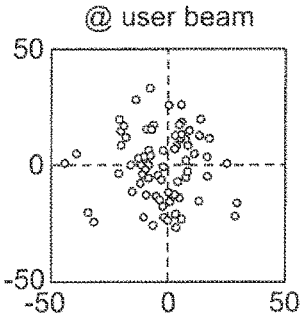
Figure 25D:
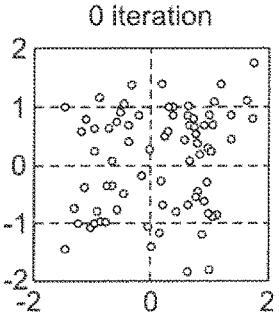

FIG. 25A-25H depict the performance of this invention to any waveforms, Quadrature Phase Shift Keying (QPSK) as an example, using an MBA antenna. An ideal QPSK signal constellations of symbols is shown in FIG. 25B. FIG. 25C depicts user beam symbols of X that is input to the apparatus of FIG. 20. The constellations at the user beam are scattered all over due to the high jammer powers, as compared to the ideal signal constellation of FIG. 25B. In FIG. 25D, the output of initial weights of FIG. 20 at the 0 iteration when the initial weight vector created using Rxx and ML alpha, is applied to the received jamming signal. The symbol constellations in four quadrants are starting to come apart as compared to FIG. 25C given that signal-to-interference-plus-noise ratio (SINR) is low as shown in FIG. 25A. Iterative Substitution method is needed to further clean up and separate the constellations.

Figure 25E:
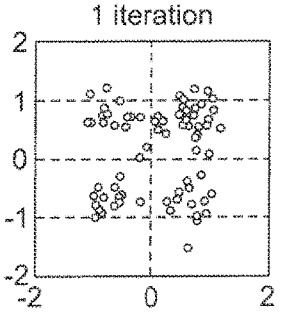
Figure 25F:
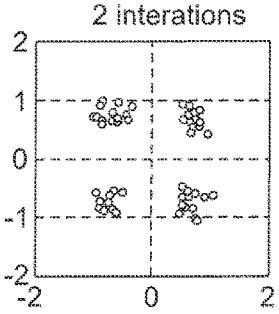
Figure 25G:
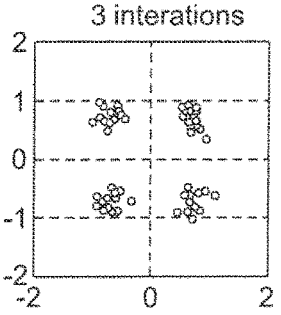

FIGS. 25E-25G show the iterative operation of the Substitution OC method. As the number of iterations of the method increases, the constellations become cleaner. After the first iteration as shown in FIG. 25E, the constellations are separate apart compared to the 0 iteration, raising the SINR (shown in FIG. 25A), thus starting to form a null on the jammer or maximizing the gain on the user. After the third iteration as shown in FIG. 25G, there is a reasonably high SINR (shown in FIG. 25A) such that the constellations are much more apparent and apart. FIG. 25H shows the antenna response with the clear gain on the user 370 while the jammer 372 is nulled out.

Figure 26A:
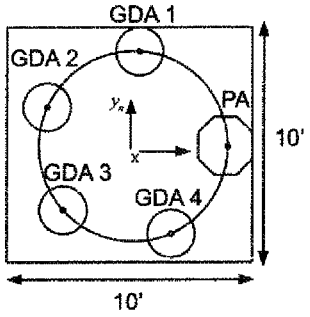
FIGS. 26A-26J depict the performance of an embodiment of the invention using a combination of different antenna types in an antenna array.
Figure 26B:
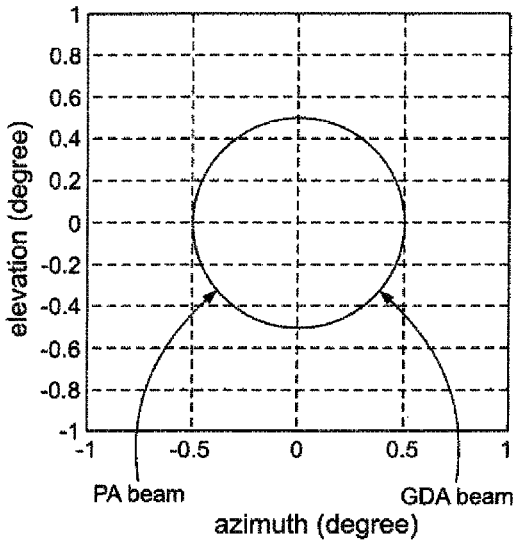
Figure 26D:
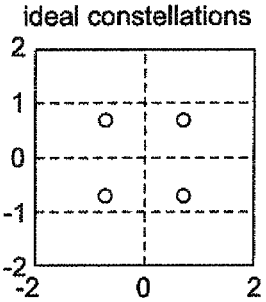
Figure 26E:
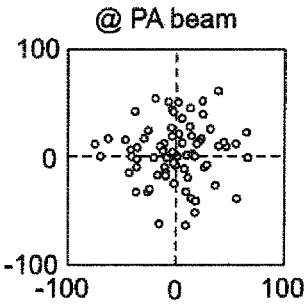
Figure 26F:
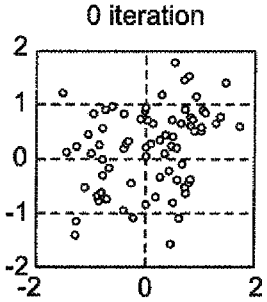
Figure 26G:
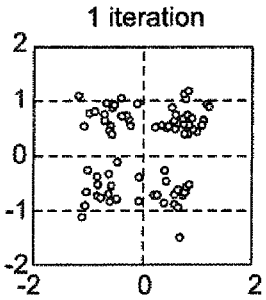
Figure 26H:
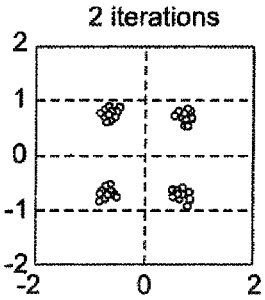
Figure 26I:
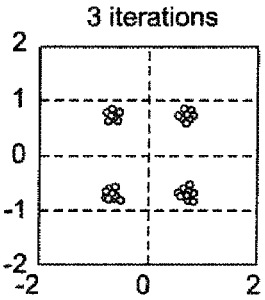
Figure 26C:
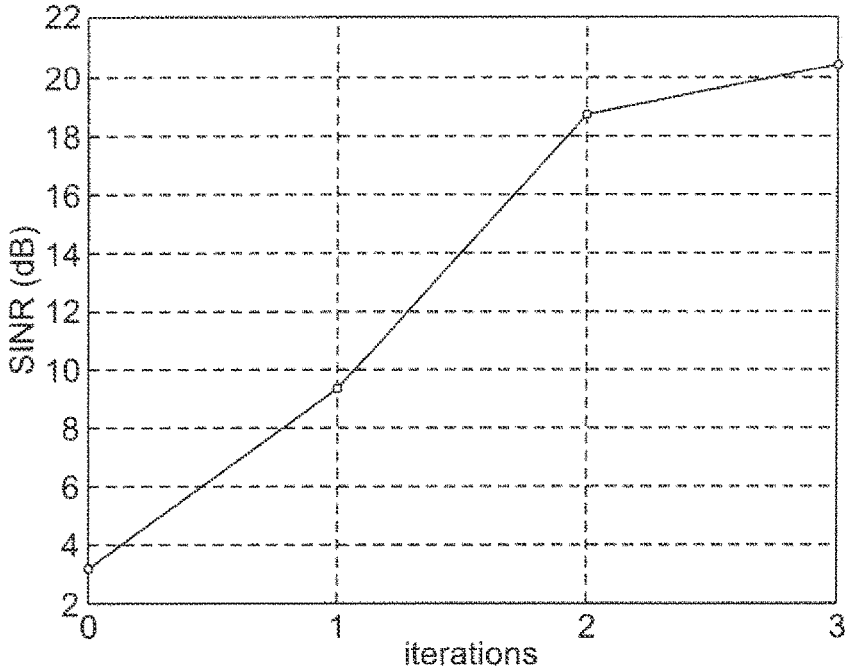
Figure 26J:
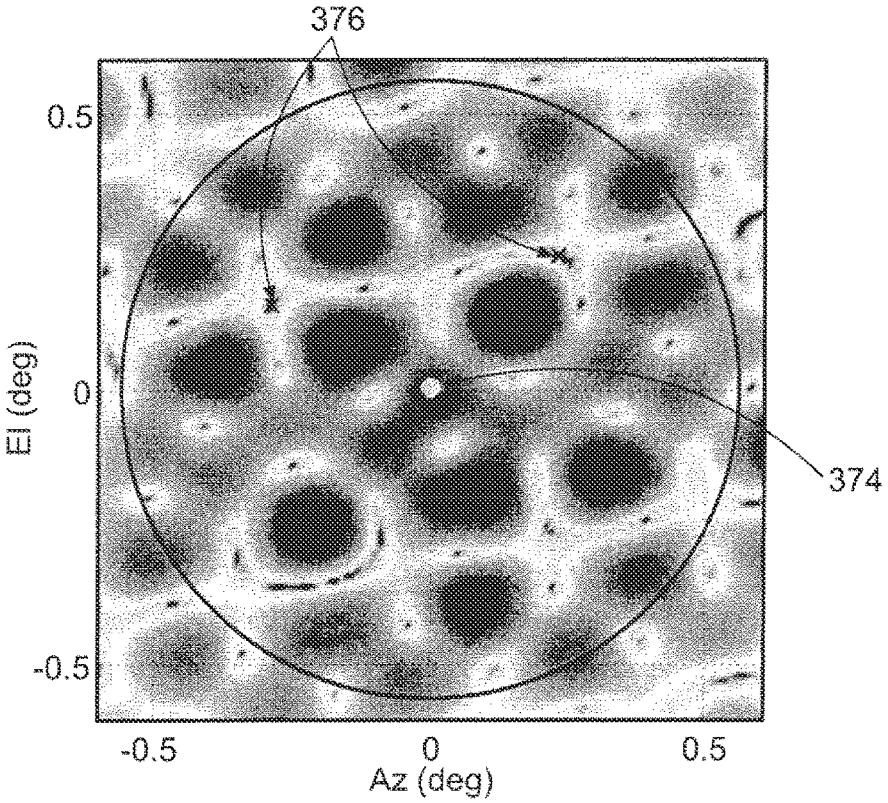

FIG. 26A shows an embodiment of the invention using a combination of different antenna types in an antenna array, e.g., 4 GDA and 1 phased array (PA) beams, with beam laydown shown in FIG. 26B, all co-pointing to the same beam. FIGS. 26G-26I show the performance of the iterative Substitution OC method for QPSK waveform as an embodiment of M-ary PSK waveforms, using the antenna architecture shown in FIG. 26A. As the number of iterations of the method increases, the constellations become cleaner. Without using any method to combat jammers, the constellations are scattered everywhere as shown in FIG. 26E. At the $0^{th}$ iteration, QPSK constellations shown in FIG. 26F start to separate in four quadrants compared to FIG. 26E. After the first iteration as shown in FIG. 26G, the constellations are separate apart compared to the $0^{th}$ iteration, raising the SINR (shown in FIG. 26C), thus starting to form nulls on the jammers or maximizing the gain on the user. After the third iteration as shown in FIG. 26I, there is a reasonably high SINR (shown in FIG. 26C) such that the constellations are much more apparent and apart. FIG. 26J shows the antenna response with the clear gain on the user 374 while the jammers 376 are nulled out.

This system may also be used with other applications. Multiple cell towers may be combined to form a large aperture, thereby increasing antenna gain and reducing interference, both of which enable higher system throughput. Ad-hoc networks can be formed from distributed users in a mobile environment (mobile wireless, airborne, etc) which would also increase system throughput through gain/interference advantages and protocols with lower overhead. Similar applications could be used to mitigate GPS jamming. The inventive system could also be used to build more conformal antennas for satellite radio-TV that do not require directional antennas that need to be pointed, thus increasing gain while lowering antenna height. This would enable the tracking of additional satellites in the antenna field of view.

The apparatus in one example comprises a plurality of components such as one or more of electronic components, hardware components, and computer software components. A number of such components can be combined or divided in the apparatus. An example component of the apparatus employs and/or comprises a set and/or series of computer instructions written in or implemented with any of a number of programming languages, as will be appreciated by those skilled in the art.

The steps or operations described herein are just for example. There may be many variations to these steps or operations without departing from the spirit of the invention. For instance, the steps may be performed in a differing order, or steps may be added, deleted, or modified.

Although example implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. A method for adaptive digital beamforming, in a computer processor, the input signals received by a plurality of heterogeneous antennas, comprising the steps of:

receiving an input signal from each beam of the plurality of antennas;

estimating an initial weight for each beam only from information contained within the input signals without using a model of the plurality of heterogeneous antennas or knowing the location of a desired signal;

processing the input signals to iteratively estimating a new weight for each beam until an optimum weight is achieved; and processing the input signals by applying the optimum weight for each beam to the input signals to digitally beamform the desired signal.

2. The method of claim 1 where in the step of estimating an initial weight further comprises the steps of:

estimating an initial steering vector from the input signals from the one or more antennas;

estimating an initial covariance matrix from the input signals using dynamic noise loading; and generating a set of weights for the input signals from the one or more antennas from the initial steering vector and the initial covariance matrix.

3. The method of claim 1 wherein the step of estimating an initial weight per beam further comprises the step of calculating a dynamic noise loading according to the equation $$nl = c_{nl}\frac{R_{xx_diag_sort}(1) + R_{xx_diag_sort}(2)}{R_{xx_diag_sort}(N_{beam} - 1) + R_{xx_diag_sort}(N_{beam})},$$

where $R_{XX}$ is a covariance matrix of received symbols from antenna beams, $R_{xx_diag_sort}$=sort(diag($R_{XX}$), descend), $c_{nl}$ is a constant, and $N_{beam}$=the number of heterogeneous antennas.

4. The method of claim 2 wherein $R_{xx_diag_sort}$ contains the diagonal elements of $R_{XX}$ in descending order, and $N_{beam} \geq 3$.

5. The method of claim 1, wherein the plurality of heterogeneous antennas further comprises an arbitrary beamforming network of arbitrary antenna elements.

6. The method of claim 5, wherein the arbitrary antenna elements are in arbitrary locations in a satellite.

7. The method of claim 5, wherein the arbitrary antenna elements are in arbitrary locations in an airborne network.

8. The method of claim 5, wherein the arbitrary antenna elements are in arbitrary locations in an ground network.

9. The method of claim 5, wherein the arbitrary antenna elements are in arbitrary locations in any space, airborne, and ground network, and any combinations of networks.

10. The method of claim 1, wherein a set of waveforms from the plurality of antennas is either coherent or partially coherent.

11. A method for digital beamforming the beams from a plurality of heterogeneous antennas, said method executed in a computer processor, comprising the steps of:

receiving an input signal from each beam of the plurality of antennas;

processing each input signal statistically to generate symbols representing each input signal;

estimating an initial steering vector for each beam from the input signal and the generated symbols;

estimating an initial covariance matrix using direct calculation with dynamic noise loading;

generating a set of weights for the beams from the plurality of antennas from the initial steering vector and the initial covariance matrix;

iteratively estimating a new weight for each beam until an optimum weight is achieved; and normalizing the optimum weight and applying it to the received symbols during digital beamforming.

12. The method of claim 11, further comprising the step of phase rotation to resolve sign ambiguity of the beamformed symbols.

13. The method of claim 11, wherein the plurality of heterogeneous antennas further comprises an arbitrary beamforming network of arbitrary antenna elements.

14. The method of claim 13, wherein the arbitrary antenna elements are in arbitrary locations in a satellite.

15. The method of claim 13, wherein the arbitrary antenna elements are in arbitrary locations in an airborne network.

16. The method of claim 13, wherein the arbitrary antenna elements are in arbitrary locations in an ground network.

17. The method of claim 13, wherein the arbitrary antenna elements are in arbitrary locations in any space, airborne, and ground network, and any combinations of networks.

18. A non-transitory computer-readable medium storing computer-readable instructions that, when executed on a computer processor, perform a method of digital beamforming the beams from a plurality of heterogeneous antennas, said method comprising the steps of:

receiving an input signal from each beam of the plurality of antennas;

processing each input signal statistically to generate symbols representing each input signal;

estimating an initial steering vector for each beam from the input signal and the generated symbols;

estimating an initial covariance matrix using direct calculation with dynamic noise loading;

generating a set of weights for the beams from the plurality of antennas from the initial steering vector and the initial covariance matrix;

iteratively estimating a new weight for each beam until an optimum weight is achieved; and normalizing the optimum weight and applying it to the received symbols during digital beamforming.

19. The method of claim 18, further comprising the step of phase rotation to resolve sign ambiguity of the beamformed symbols.

20. The method of claim 18 wherein the step of estimating an initial covariance matrix for each beam further comprises the step of calculating a dynamic noise loading according to the equation $$nl = c_{nl}\frac{R_{xx_diag_sort}(1) + R_{xx_diag_sort}(2)}{R_{xx_diag_sort}(N_{beam} - 1) + R_{xx_diag_sort}(N_{beam})},$$

where $R_{XX}$ is a covariance matrix of received symbols from antenna beams, $R_{xx_diag_sort}$=sort(diag($R_{XX}$), descend), $c_{nl}$ is a constant, and $N_{beam}$=the number of heterogeneous antennas.

21. The method of claim 18 wherein $R_{xx_diag_sort}$ contains the diagonal elements of $R_{XX}$ in descending order, and $N_{beam} \geq 3$.

22. The method of claim 18, wherein the plurality of heterogeneous antennas further comprises an arbitrary beamforming network of arbitrary antenna elements.

23. The method of claim 22, wherein the arbitrary antenna elements are in arbitrary locations in a satellite.

24. The method of claim 22, wherein the arbitrary antenna elements are in arbitrary locations in an airborne network.

25. The method of claim 22, wherein the arbitrary antenna elements are in arbitrary locations in an ground network.

26. The method of claim 22, wherein the arbitrary antenna elements are in arbitrary locations in any space, airborne, and ground network, and any combinations of networks.

* * * * *